US008347530B2

(12) United States Patent
Clendenning et al.

(10) Patent No.: US 8,347,530 B2
(45) Date of Patent: Jan. 8, 2013

(54) TOOTH ASSEMBLY AND RELATED METHOD FOR RELEASABLY COUPLING A TOOTH TO AN ADAPTER

(75) Inventors: Charles Clendenning, Broken Arrow, OK (US); Russell N. Drake, Claremore, OK (US); Brian L. Launder, Tulsa, OK (US)

(73) Assignee: H&L Tooth Company, Tulsa, OK (US)

( * ) Notice: Subject to any disclaimer, the term of this patent is extended or adjusted under 35 U.S.C. 154(b) by 125 days.

(21) Appl. No.: 12/806,010

(22) Filed: Aug. 4, 2010

(65) Prior Publication Data

US 2011/0030248 A1 Feb. 10, 2011

Related U.S. Application Data

(60) Provisional application No. 61/273,547, filed on Aug. 5, 2009.

(51) Int. Cl.
*E02F 9/28* (2006.01)

(52) U.S. Cl. ..... 37/452; 37/456

(58) Field of Classification Search ..... 37/395, 37/398, 450–460; 403/373, 374, 355, 320
See application file for complete search history.

(56) References Cited

U.S. PATENT DOCUMENTS

| | | | |
|---|---|---|---|
| 1,485,879 | A | 3/1924 | Page |
| 1,620,132 | A | 3/1927 | Psilander |
| 2,259,456 | A | 10/1941 | Crawford |
| 3,312,004 | A | 4/1967 | Johnson |
| 3,371,437 | A | 3/1968 | Wilson et al. |
| 3,471,954 | A | 10/1969 | Spivey |
| 3,678,605 | A | 7/1972 | Prime |
| 3,982,339 | A | 9/1976 | Nilsson |

(Continued)

FOREIGN PATENT DOCUMENTS

CA 605679 9/1960

OTHER PUBLICATIONS

International Searching Authority; PCT International Search Report in PCT International Application No. PCT/US2010/002165; Sep. 30, 2010; 3 pages.

(Continued)

*Primary Examiner* — Robert Pezzuto
(74) *Attorney, Agent, or Firm* — Law Office of John W. Harbst

(57) ABSTRACT

A tooth assembly including an adapter and a tooth. The adapter has a nose portion with a first predetermined configuration. The tooth is assembled onto the adapter nose portion by relative longitudinal movement. The tooth defines a blind cavity having a second predetermined configuration and opening to a rear of the tooth. The second predetermined configuration defined by the tooth cavity is greater than the first predetermined configuration defined by the adapter nose portion such that a space is provided between the adapter nose portion and the blind cavity when the adapter and tooth are arranged in operable combination relative to each other. A securement member releasably maintains the tooth and the adapter nose portion in operable combination relative to each other. The securement member fills the space defined between the tooth cavity and the adapter nose portion to resist longitudinal movement between the tooth and the adapter nose portion. A related method for releasably coupling a tooth to an adapter is also disclosed.

39 Claims, 17 Drawing Sheets

U.S. PATENT DOCUMENTS

| | | | |
|---|---|---|---|
| 4,027,408 | A | 6/1977 | Ramella et al. |
| 4,182,058 | A | 1/1980 | Poncin |
| 4,187,035 | A | 2/1980 | Colburn |
| 4,274,678 | A | 6/1981 | Herridge |
| 4,880,247 | A | 11/1989 | Herridge |
| 5,074,062 | A | 12/1991 | Hahn et al. |
| 5,379,535 | A | 1/1995 | Bowes, Jr. |
| 5,469,648 | A | 11/1995 | Jones et al. |
| 5,561,925 | A | 10/1996 | Livesay |
| 5,713,145 | A | 2/1998 | Ruvang |
| 6,047,487 | A | 4/2000 | Clendenning |
| 6,247,255 | B1 | 6/2001 | Clendenning |
| 6,799,387 | B2 * | 10/2004 | Pippins ..... 37/456 |
| 2003/0140531 | A1 | 7/2003 | Pippin |
| 2006/0059732 | A1 | 3/2006 | Clendenning et al. |
| 2006/0236567 | A1 | 10/2006 | Adamic |
| 2008/0000114 | A1 | 1/2008 | Bentley |
| 2012/0017474 | A1 | 1/2012 | Corredor et al. |

OTHER PUBLICATIONS

International Searching Authority; Written Opinion of the International Searching Authoirty in PCT International Application No. PCT/US2010/002165; Sep. 30, 2010; 9 pages.

* cited by examiner

TOOTH ASSEMBLY AND RELATED METHOD FOR RELEASABLY COUPLING A TOOTH TO AN ADAPTER

CROSS REFERENCE TO RELATED APPLICATIONS

This application is based on and claims the benefit of and coassigned provisional patent application Ser. No. 61/273,547 filed Aug. 5, 2009.

FIELD OF THE INVENTION DISCLOSURE

This invention disclosure generally relates to a tooth assembly and, more specifically, to a tooth assembly including an adapter and a tooth arranged in releasably coupled relation relative to each other and to a related method for releasably coupling the tooth and adapter.

BACKGROUND

Excavating or digging equipment used in mining, construction and a myriad of other ground engaging operations typically includes a series of spaced apart tooth assemblies which project forward and serve to break up material to be gathered into a bucket of such digging equipment. Such tooth assemblies are typically arranged in side-by-side and horizontally adjacent relation relative to each other.

Such tooth assemblies can take a myriad of shapes and sizes. As used herein, the phrases "tooth" and "wear part" are intended to include lip protectors, lip shrouds, rippers and other ground engaging tools including, but not limited to, ground engaging teeth. For exemplary purposes, this invention disclosure is illustrated and described for use with a two-piece ground engaging tooth assembly. As mentioned, however, the present invention is equally applicable to other ground engaging equipment releasably secured to an edge or lip of a bucket or related digging equipment.

The art recognized long ago the advantages to be gained by constructing each tooth assembly as a two-part system. That is, the art recognized the advantages to be obtained by connecting a tooth or tool to an adapter or support which, in turn, is connected to the bucket of excavating equipment. Typically, the adapter or support is provided with a base portion which is configured for attachment to the forward edge or lip of a bucket and a free ended nose portion. The tooth is typically provided with a blind cavity or socket whereby allowing the tooth to longitudinally fit over and along at least a lengthwise section of the adapter nose portion. The size of the adapter and tooth vary depending upon the particular digging application. Various types of pinning systems have been used to releasably interconnect the tooth and adapter in operable combination relative to each other.

In some operations, such tooth assemblies are subjected to highly abrasive conditions and, thus, experience considerable and rapid wear. Unless the conjuncture between the component parts is properly fitted, wear problems, especially in the socket or cavity of the replacement part and along the nose portion of the adapter, can result. Moreover, the relatively high forces developed during some digging operations furthermore add to the rapid wear of the component parts of the tooth assembly. Additionally, the pinning systems used to interconnect the tooth and adapter can be harmed or even destroyed by excessive loading in field applications which can result in inadvertent separation of the tooth from the adapter nose portion.

Besides wear in the socket or cavity area of the replacement part or tooth, the adapter nose portion can also become worn from use in the field. Accordingly, and when a new replacement part is fitted to a worn nose portion of an adapter, clearances can exist between the adapter nose portion and the digging tooth. As a result, there can be significant movement between the new replacement part and the nose portion of the adapter. This movement furthermore wears on the nose portion of the adapter and increases the loads upon conventional pinning systems due to excessive tooth movements.

In service, and although specific steps can be taken during fabrication of the wear part to prolong their usefulness, a forward cutting edge of the replacement part sometimes quickly wears and becomes dull and, thus, inefficiencies in the digging operation develop thereby requiring replacement of such parts. As mentioned, the two-part construction of such a tooth assembly advantageously allows the tooth to be replaced independent of the adapter. Depending upon conditions, an adapter can be successfully equipped with anywhere from five to thirty replacement teeth to maintain a sharp penetrating edge for the tooth assembly. In the field, replacement of worn teeth is a common and sometimes a daily experience.

Removing or separating a worn or otherwise broken tooth from its support can involve a tedious and often difficult task of pounding or prying an elongated retaining pin from registering apertures in the tooth and adapter. Removal of the retaining pin is typically effected by using a hammer to manually and endwise force the retaining pin from the apertures in the tooth and adapter. Of course, with larger tooth assemblies, the retaining pins are proportionately sized larger thereby adding to the manual effort and, thus, increasing the time and effort involved to effect digging tooth replacement and/or repair. Problems involving the hammer missing the punch or other tool used to removably pound the retaining pin and hitting the hand of the operator are well known. Dangerous splintering of the metal parts used to drive the retaining pin from between the tooth and adapter can also result. Of course, similar problems exist when the retaining pin is again pounded into the apertures to effect reattachment of the replacement part to the adapter. The unavailability of appropriate tools, i.e., hammers and punches, in the field is also a consistent and well known problem.

Many tooth assemblies arrange the retaining pin along a generally horizontal axis. When the tooth assemblies are mounted in side-by-side proximate relation relative to each other across the bucket edge, however, the horizontal disposition of the retainer pin for each tooth assembly only adds to the time and effort required to initially remove the pin, whereby allowing for removal/repair of the worn/broken part of the two-part system and, subsequent reinsertion of the pin into the registered apertures in the replacement part and adapter. Some operators utilize specially designed tools to facilitate removal of the horizontal pins.

It is also known to arrange the retaining pin in a generally vertical orientation. While advantageously enhancing access to the retaining pin, such retaining devices are more susceptible to the forces applied thereto as a result of the generally vertical movements of the bucket during a digging/excavating operation. Moreover, with a vertically oriented pin system, the lower hole or aperture in the replacement part of the two-part digging system is more exposed—as compared to a horizontal pinning system—to the ground surface over which the digging implement or bucket moves during a digging operation.

Typically, changing to a unique tooth design can create considerable hardship on original equipment manufacturers, part distributors, and end users since a new style adapter most likely must also be utilized to accommodate the innovative tooth and attachment device. This can require costly maintenance of multiple part inventories throughout the entire parts distribution system. This can also cause confusion as to which new tooth and pin will fit what adapter, which tool is needed, etc. Those concerns listed above at least partially explains the reluctance of some manufacturers and even end-users to accept and adopt a newer type of tooth assembly, even after considering the advantages such a new tooth assembly design can offer.

Thus, there is a need and continuing desire for a digging tooth assembly wherein the wear part or tooth and adapter are releasably maintained in operable combination relative to each other and for a related method for releasably coupling the tooth to an adapter. Also, there is a need and continuing desire for a tooth assembly wherein the wear part can be removed from and reassembled to the adapter without requiring the use of a hammer. Moreover, there is an even greater need for a new tooth design that can manifest numerous advantages for the manufacturer of the tooth and yet be utilized in combination with either new style adapters or with the existing population of older style adapters in the field.

SUMMARY

In view of the above, and in accordance with one aspect, there is provided a tooth assembly having a longitudinal axis and includes a tooth and adapter. The tooth has upper and lower slanted walls and a rearwardly opening socket formed therein. The tooth socket has a first cross-sectional configuration defined, at least partially by a pair of opposed sides laterally separated by a predetermined distance. At least one of the sides of the tooth socket has a generally planar configuration. The adapter has a nose portion configured to be longitudinally received and accommodated within the tooth socket. The adapter nose portion has a second cross-sectional configuration which proximate but is smaller than the cross-sectional configuration of the tooth socket such that, when the when the adapter nose portion and tooth are arranged in operable combination relative to each other, a relief is defined between confronting surfaces on the tooth socket and adapter nose portion. The adapter nose portion further defines a recess for laterally accommodating a free ended lock carried by the tooth and projecting toward the longitudinal axis of the tooth assembly for releasably coupling the tooth and adapter in operable combination relative to each other. A securement member is insertable into the relief defined between the confronting surfaces on the tooth socket and adapter nose portion so as to at least partially fill the relief and urge the tooth in a lateral direction relative to the adapter nose portion thereby forcibly maintaining the lock on the tooth securely within the recess in the adapter whereby inhibiting longitudinal translation of the tooth relative to the adapter as long as the lock retained within the recess defined by the adapter nose portion.

In one form, the lock on the tooth is a lug formed integral with the tooth. In another form, the lock carried by the tooth is assembled to the tooth. Preferably, a lower wall of the tooth defines a bore extending through to the tooth socket so as to accommodate endwise passage of a tool from an underside of the securement member whereby facilitating removal of the securement member from operable engagement with the tooth and adapter.

In one form, the securement member has a shank portion with opposed and generally parallel sides. To guide and facilitate insertion of the securement member into operable combination with and between confronting surfaces on the adapter nose portion and tooth socket, a key and keyway are provided between the securement member and a confronting side surface of the tooth socket. To advantageously promote removal of the securement member from between the digging tooth and adapter nose portion, the shank portion of the securement member disposed between the tooth and adapter nose portion preferably has an arcuate configuration between opposed ends thereof. The configuration of and the lateral distance between the shank portion sides of the securement member can vary between different securement members.

A secondary lock is preferably provided in combination with the tooth assembly for releasably maintaining the securement member in position between the tooth and the adapter nose portion. Magnetic material can be arranged in combination with the securement member to inhibit inadvertent displacement thereof from between the tooth and adapter nose portion. In one form, the secondary lock is designed as a detent mechanism. In another form, an insert carried by the tooth with a portion of the insert being arranged in operable combination with and serves to maintain the securement member in position between the tooth and the adapter nose portion. In still another form, the secondary lock includes magnetic material.

According to another aspect, there is provided a tooth assembly having a longitudinal axis and which includes an adapter and a tooth. The adapter has a nose portion with top and bottom angled surfaces converging toward a free end thereof and a pair of sides which are laterally separated by a first predetermined distance. The adapter nose portion further defines a recess opening to both sides of the nose portion of the adapter. The tooth is assembled onto the nose portion of the adapter by relative longitudinal movement. The tooth has an upper wall and a lower wall and a blind cavity opening to a rear of the tooth. The tooth cavity has top and bottom angled surfaces, which proximate the respective top and bottom angled surfaces on the nose portion of the adapter, and a pair of generally parallel side surfaces extending between the top and bottom surfaces and which are laterally separated by a second predetermined distance. The second predetermined distance is greater than the first predetermined distance. At least one side surface of the tooth cavity has a generally planar configuration. A free ended lock on the tooth extends toward the tooth assembly axis and aligns with and extends into the recess in the nose portion of the adapter when the adapter and tooth are longitudinally assembled relative to each other. A securement member is insertable between and in bearing contact with both the side surface of the tooth cavity and the respective side of the nose portion of the adapter to releasably maintain the lock on the tooth within the recess in the adapter so as to prevent longitudinal movement of the tooth and adapter relative each other.

In one form, an opening is provided in the upper wall of the tooth. The opening extends into the tooth cavity and is arranged adjacent to the side surface of the blind cavity opposite from the lock for allowing at least a portion of said securement member to pass downwardly therethrough and into operable combination between and in bearing contact with a side of the adapter and an adjacent side surface defining the cavity in the tooth. As such, the lock on the tooth is urged into the recess in the adapter so as to prevent longitudinal movement of the tooth and adapter relative each other.

In one embodiment, the lock on the tooth is a lug that is formed integral with the tooth. In another embodiment, the lock is formed as an insert carried by the tooth. In a preferred embodiment, the lower wall of the tooth defines a bore for accommodating endwise passage of a tool used to facilitate removal of said securement member from operable engagement between said tooth and adapter.

In one form, the securement member has a pair of parallel sides. A key and keyway on the tooth and securement member facilitate insertion of the securement member between the tooth and adapter nose portion. Moreover, and to facilitate removal of the securement member from between the tooth and adapter nose portion, at least that portion of the securement member extending between the tooth and adapter nose portion has an arcuate configuration between the ends thereof.

Preferably, a secondary lock is provided for releasably maintaining the securement member in operable combination with the adapter and tooth. In one embodiment, such secondary lock is designed as detent mechanism. In another form, the securement member includes magnetic material for releasably maintaining said securement member in position between said tooth and the adapter nose portion. In another embodiment, an insert, carried by the tooth opposite from the lock on the tooth, is arranged in operable combination with the securement member for releasably maintaining the securement member between the adapter and tooth. In one form, such insert is maintained in place by magnetic material.

According to another aspect, there is provided a tooth assembly having a longitudinal axis and includes an adapter and a tooth. The adapter has a base portion adapted to be secured to excavating equipment and a forwardly extending nose portion with a first predetermined configuration. The tooth is assembled onto the adapter nose portion by relative longitudinal movement. The tooth defines a blind cavity opening only to a rear of the tooth. The tooth cavity has a second predetermined configuration. Notably, in this form, the second predetermined configuration defined by the tooth cavity is greater than the first predetermined configuration defined by the adapter nose portion such that a relief is defined between one side of the adapter nose portion and a confronting side surface of the tooth cavity when the adapter and tooth are arranged in operable combination relative to each other. A lock on the tooth releasably maintains the tooth and the adapter nose portion in operable combination relative to each other. The lock projects toward the longitudinal axis of the tooth assembly and extends into a recess defined on the adapter nose portion when the adapter nose portion and tooth are arranged in operable combination relative to each other. A securement member is insertable between and at least partially fills the space between the side surface of the tooth cavity and the confronting side of the adapter nose portion and urges the lock into the recess defined in the adapter nose portion whereby resisting longitudinal movement between the tooth and the adapter nose portion as long as the securement member is arranged between the tooth and adapter nose portion.

In one form, lock on the tooth is formed as an integral free ended lug extending toward the longitudinal axis of the tooth assembly. Alternatively, however, the lock on the tooth can be formed as an insert carried by the tooth. In one form, the lower wall of the tooth defines a bore arranged adjacent to one of the side surface of and extends through to the blind cavity for accommodating endwise passage of a tool used to facilitate removal of the securement member from operable engagement with the tooth and adapter.

Preferably, a lengthwise portion of the securement member extends across an entire side of the adapter when the securement member is fully inserted into an operational position. In one embodiment, the portion of the securement member insertable between the tooth and adapter nose portion has an arcuate configuration between opposed ends thereof. Preferably, a key and keyway defined by the tooth and securement member serve to guide the securement member into operable position between the tooth and adapter. The securement member preferably has two laterally separated and generally parallel sides.

According to still another aspect, there is provided a tooth assembly having a longitudinal axis and includes an adapter and a tooth. The adapter has a base portion adapted to be secured to excavating equipment and a forwardly extending nose portion having a first predetermined configuration. The tooth is assembled onto the nose portion of the adapter by relative longitudinal and lateral movements. The tooth defines a blind cavity opening only to a rear of the tooth, with the blind cavity having a second predetermined configuration defined by at least one side extending generally parallel to the longitudinal axis of the tooth assembly. The second predetermined configuration of the tooth cavity is larger than the first predetermined configuration on the adapter nose portion such that, when said adapter nose portion and tooth are arranged in operable combination relative to each other, a space is defined between said at least that side on the tooth cavity extending generally parallel to the longitudinal axis of the tooth assembly and a confronting surface on the nose portion of the adapter. A securement member is insertable in a direction extending generally perpendicular to the longitudinal axis of the tooth assembly such that a portion of the securement member at least partially fills the space defined between that one side on the tooth cavity extending generally parallel to the longitudinal axis of the tooth assembly and a confronting surface on the nose portion of the adapter to positively urge the tooth in a direction whereby allowing remaining configurations on the adapter nose portion and tooth cavity to resist longitudinal movement between the tooth and the adapter nose portion as long as the securement member is disposed between the adapter nose portion and tooth.

In this embodiment, both sides of the adapter nose portion angle inwardly toward the longitudinal axis of the tooth assembly such that the lateral cross-sectional configuration of the adapter nose portion decreases as measured from the free end of the adapter. In one form, at least a portion of the securement member has a wedge shaped design. In this alternative design, the other side surface of the blind cavity defined by the tooth angles inwardly toward the longitudinal axis of the tooth assembly such that the lateral width between the side surfaces of the blind cavity is greater at a closed end of the cavity than at an open end of the cavity.

According to still another aspect, there is provided a method for releasably coupling a tooth to an adapter. The tooth has converging upper and lower walls and a rearwardly opening socket formed therein. The tooth socket has a first predetermined configuration. The adapter has a nose portion adapted to be longitudinally received and accommodated within the socket defined by the tooth. The adapter nose portion has a second predetermined configuration which compliments but is smaller than the predetermined configuration defined by the tooth socket. As such, and when the tooth and adapter nose portion are arranged in operable combination relative to each other, a space is defined between the tooth cavity and the adapter nose portion. The method for releasably coupling the tooth and adapter includes the step of: inserting a securement member between confronting side surfaces on the tooth socket and adapter nose portion so as to couple the tooth and adapter in operable combination relative to each other and to inhibit longitudinal translation of the tooth relative to the adapter as long as the securement member is retained between the tooth and the nose portion of the adapter.

In one form, the method for releasably coupling the tooth to the adapter includes the further step of: angling the tooth in a first sideways direction sufficiently to permit longitudinal translation of a free end of the adapter into the tooth socket. Moreover, the method for releasably coupling the tooth to the adapter can furthermore include the step of: angling the tooth in a second sideways direction sufficiently align the tooth and adapter along a longitudinal axis defined by the tooth assembly. Preferably, the method for releasably coupling the tooth to an adapter furthermore includes the step of: using a secondary locking apparatus for releasably securing said tooth and adapter in operable combination relative to each other.

DETAILED DESCRIPTION

Figure 1:
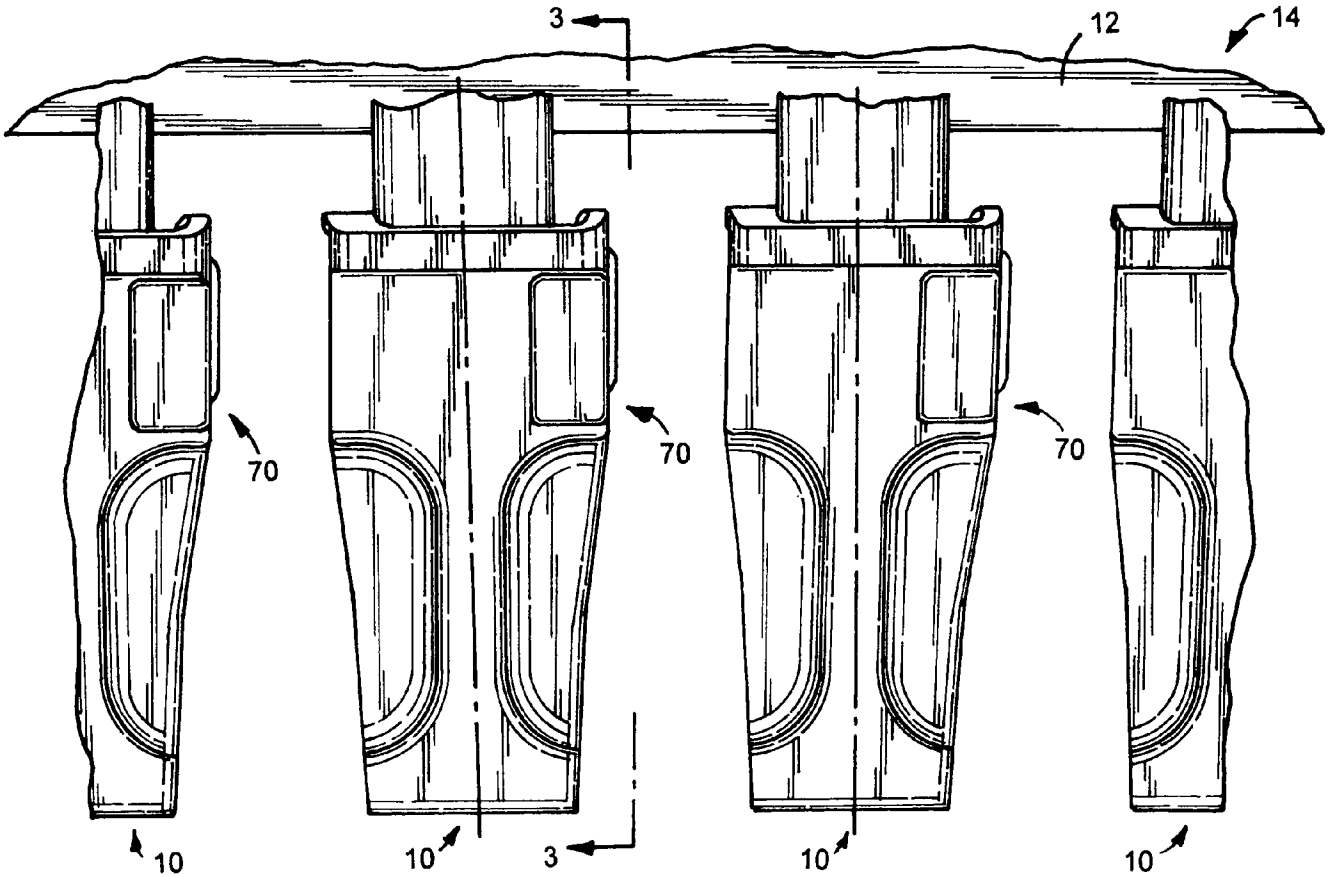
FIG. 1 is a fragmentary top plan view of one form of tooth assembly embodying principals and teachings of the present disclosure.

While this invention disclosure is susceptible of embodiment in multiple forms, there is shown in the drawings and will hereinafter be described preferred embodiments, with the understanding the present disclosure sets forth exemplifications of the disclosure which are not intended to limit the disclosure to the specific embodiments illustrated and described.

Referring now to the drawings, wherein like reference numerals indicate like parts throughout the several views, there is shown in FIG. 1 a series of two-part digging tooth assemblies, with each assembly being identified generally by reference numeral 10. In the illustrated embodiment, the tooth assemblies are arranged in generally horizontal and proximate relation relative to each other across an edge or lip 12 of an implement such as a bucket or the like 14. During operation, the bucket or shovel 14, to which each tooth assembly is attached, moves both vertically and horizontally. Each tooth assembly 10 extends forward from the implement edge or lip 12. Preferably, each tooth assembly 10 is substantially identical in construction. Accordingly, only one tooth assembly will be discussed in detail.

Figure 2:
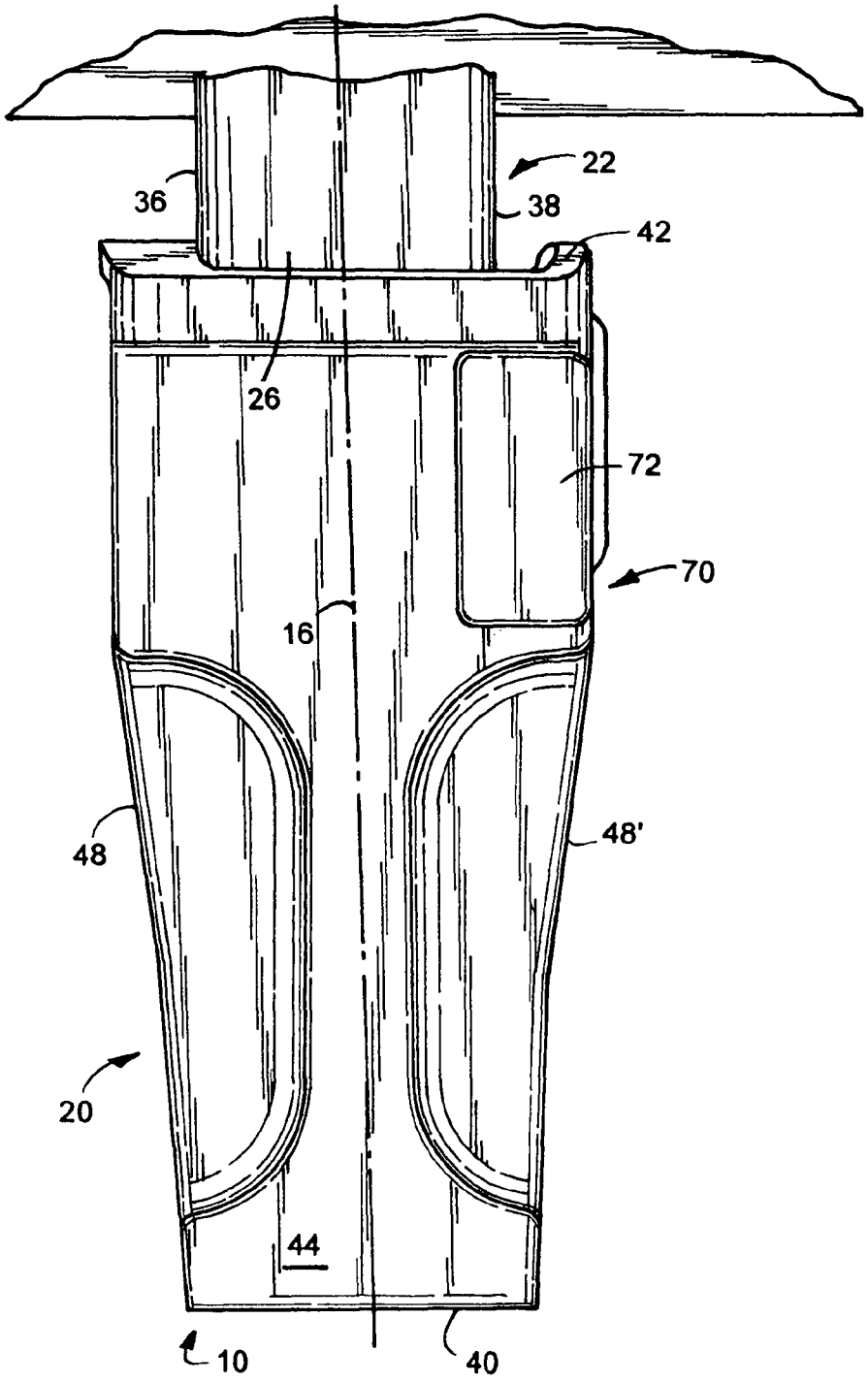
FIG. 2 is an enlarged top plan view of one tooth assembly illustrated in FIG. 1.

As shown in FIG. 2, each tooth assembly 10 has a longitudinal axis 16 and includes a replaceable wear part 20 and an adapter 22. In the illustrated embodiment, the replaceable wear part 20 is designed as a digging tooth. As mentioned, however, the wear part of assembly 10 can take a myriad of different designs other than a tooth, i.e., a ripper, lip shroud, wear cap, etc. without detracting or departing from the true spirit and scope of this invention disclosure.

Figure 3:
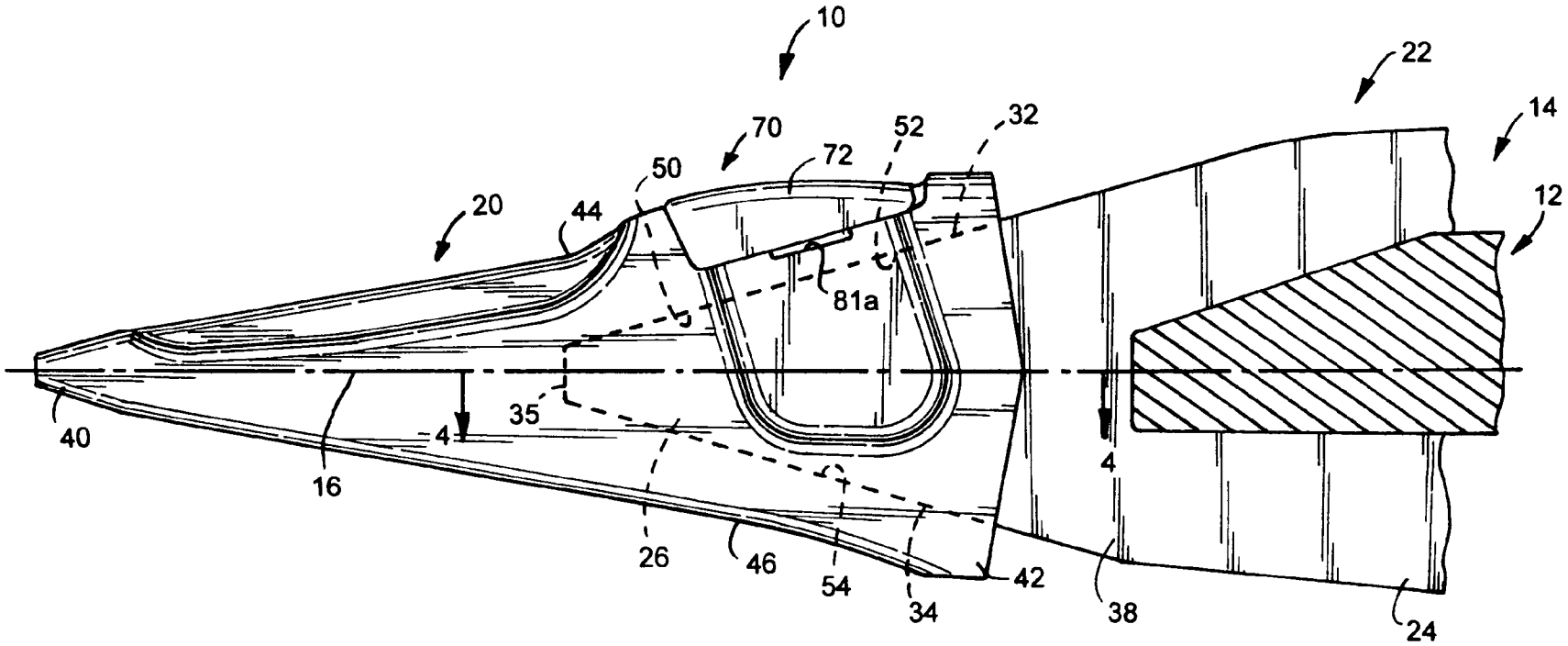
FIG. 3 is a sectional view taken along line 3-3 of FIG. 1.

In the embodiment illustrated by way of example in FIG. 3, the adapter 22 has an elongated and preferably unitary construction and includes a base portion 24 and an elongated nose portion 26 projecting forward from the base portion 24. To add to the wearability thereof, adapter 22 is preferably formed from a ferrous metal, i.e., steel or a steel alloy. The adapter base portion 24 is configured for suitable attachment to the edge or lip 12 of the bucket or implement 14 through any suitable and well known means including fasteners, welding, etc.

Figure 4:
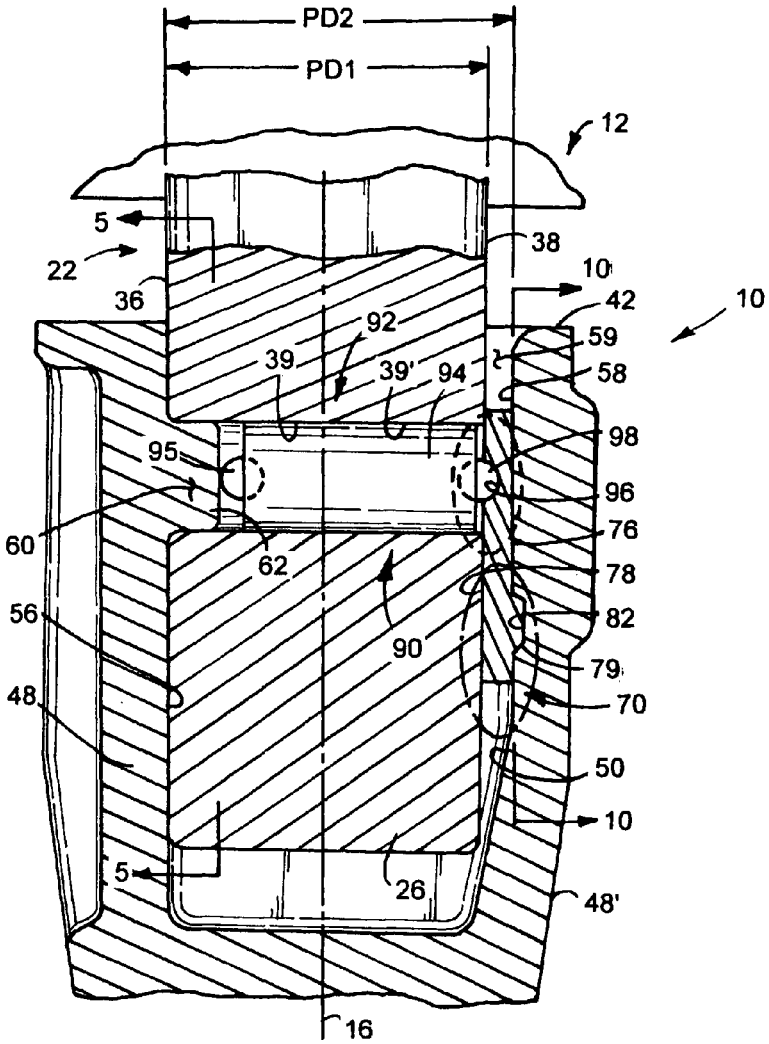
FIG. 4 is a sectional view taken along line 4-4 of FIG. 3.
Figure 17:
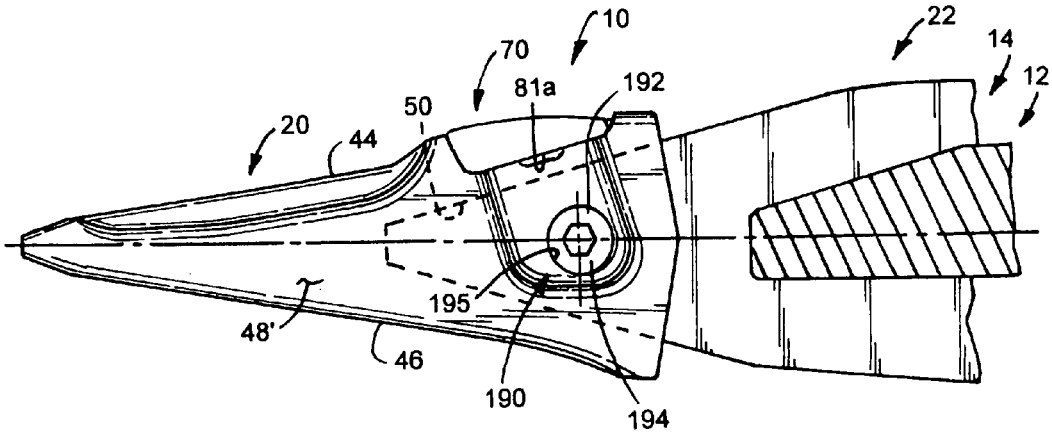
FIG. 17 is a view similar to FIG. 3 showing the alternative secondary lock for use in combination with this invention disclosure.

The adapter nose portion 26 can take any of a myriad of different designs without detracting or departing from the true spirit and scope of this invention disclosure. Suffice it to say, the configuration of the adapter nose portion 26 illustrated by way of example in FIGS. 3, 4 and 17 is such that a longitudinal cross-sectional configuration of the adapter nose portion 26 increases as measured rearwardly from a free end of the adapter nose portion 26. In the example selected for illustrative purposes in FIG. 3, the adapter nose portion 26 has top and bottom angled surfaces 32 and 34 which converge relative to each other and toward a free end 35 of the adapter 22. In the embodiment shown in FIGS. 2 and 4, the adapter nose portion 26 furthermore includes a pair of laterally spaced sides 36 and 38 which, in the form used as an example, extend generally parallel to each other. As shown in FIG. 4, the sides 36 and 38 of the adapter nose portion 22 are laterally separated or spaced apart by a predetermined transverse distance PD 1. Suffice it to say, the adapter nose portion 26 has a first predetermined configuration.

As shown in FIG. 4, the adapter or support 22 defines a recess or bore 39 disposed toward a rear of the nose portion 26 and extends generally normal to the tooth assembly axis 16. In the form shown in FIG. 4, recess 39 is defined by a through-bore 39' which opens to opposed sides 36 and 38 of the adapter nose portion 26. In the illustrated embodiment, recess 39 has a closed marginal edge. In the illustrated embodiment, the closed marginal edge of the recess 39 has a generally elliptical cross-sectional configuration which is elongated in a fore-and-aft direction but it could have other cross-sectional configurations i.e, circular, square, triangular, etc. without detracting or departing from the true spirit and scope of this invention disclosure.

In the example shown in FIG. 3, the wear part or tooth 20 of assembly 10 has an longitudinally elongated wedge shape between a forward cutting edge or end 40, operative to engage the material to be worked, and a rear end 42 thereof. Like adapter 22, tooth 20 is preferably formed from a ferrous metal, i.e., steel or a suitable steel alloy. Preferably, tooth 20 has a unitary design including an upper slanted wall 44 and a lower slanted wall 46 arranged in converging relation toward the end 40 of the tooth 20. As shown in FIG. 2, tooth 20 further includes a pair of side walls 48 and 48' extending between walls 44 and 46. Of course, the exterior sides of tooth 20 can take a myriad of different shapes from that shown without detracting or departing from the true spirit and scope of this disclosure.

As shown in FIG. 4, the wear part or tooth 20 defines an open-ended blind cavity or socket 50 for longitudinally receiving and accommodating at least a lengthwise section of the adapter nose portion 26. Suffice it to say, socket 50 has a predetermined configuration which compliments or proximates the configuration of the adapter nose portion 26. In the illustrated form, the socket 50 has a larger cross-sectional configuration toward an open end than toward a closed end thereof. In the illustrated embodiment, the tooth cavity or socket 50 has top and bottom angled surfaces 52 and 54 (FIG. 3) which compliment the top and bottom angled surfaces 32 and 34, respectively, on the adapter nose portion 26 and which converge relative to each other. The tooth cavity or socket 50 furthermore includes a pair of laterally spaced side surfaces 56 and 58 which, in one form, extend generally parallel to each other and to the longitudinal axis 16 of tooth assembly 10. Suffice it to say, the adapter nose portion 26 and tooth cavity or socket 50 have complimentary cross-sectional designs and/or configurations. It should be appreciated, however, the design, shape and/or configurations of the adapter nose portion 26 and tooth cavity or socket 50 can be different from that shown for illustrative purposes without detracting or departing from the true spirit and scope of this invention disclosure.

As shown in FIG. 4, the side surfaces 56 and 58 of cavity 50 are laterally separated or spaced apart by a predetermined transverse distance PD 2; with the predetermined lateral distance PD2 being greater than the predetermined lateral distance PD1 defined between the sides 36 and 38 of the adapter nose portion 22. That is, the predetermined configuration of the tooth cavity 50 is larger in cross-section than the predetermined configuration defined by the adapter nose portion 26. As such, and as shown in FIG. 4, when the adapter nose portion 26 is operably assembled within the tooth cavity 50, a space or relief 59 is defined between one side of the adapter nose portion 26 and the confronting side surface 58 of cavity 50 and longitudinally opens to a rear of the wear part or tooth 20.

Figure 5:
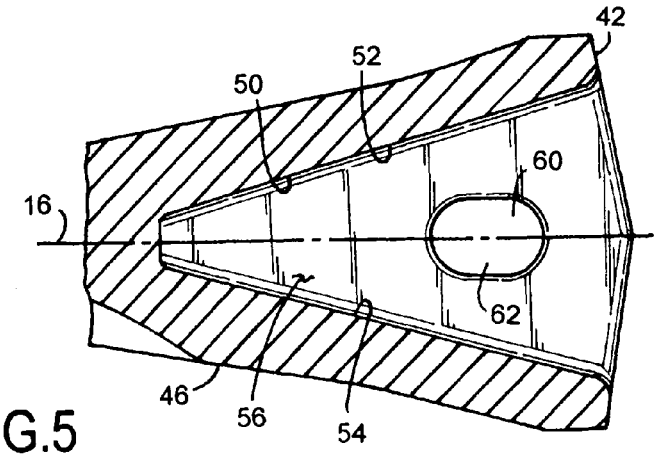
FIG. 5 is a sectional view taken along line 5-5 of FIG. 4.

In the embodiment shown in FIGS. 4 and 5, a free ended lock 60 extends into the socket 50 and toward the tooth assembly axis 16. The lock 60 has a cross-sectional configuration which is equal to or smaller than the cross-section of the recess 39 defined by the adapter nose portion 26. Notably, the lateral distance separating the free end of lock 60 from the opposed side surface 58 of tooth cavity 50 is greater than the lateral distance separating opposed sides 36 and 38 of the adapter nose portion 26 whereby permitting longitudinal translation of the adapter nose portion 26 relative to the tooth socket 50 and longitudinally past lock 60. In the illustrated embodiment, lock 60 is a lug 62 formed integral with the tooth 20. As shown in FIG. 4, when the adapter nose portion 26 and tooth 50 are arranged in operable combination with each other, lock 60 is in registry with and extends into the recess 39 defined by the adapter nose portion 26. As such, the working loads and forces encountered by the tooth assembly 10 during operation are advantageously transferred from the digging tooth 20 to the adapter 22 through the lock 60 extending into the recess 39 on the adapter nose portion 26.

Figure 4A:
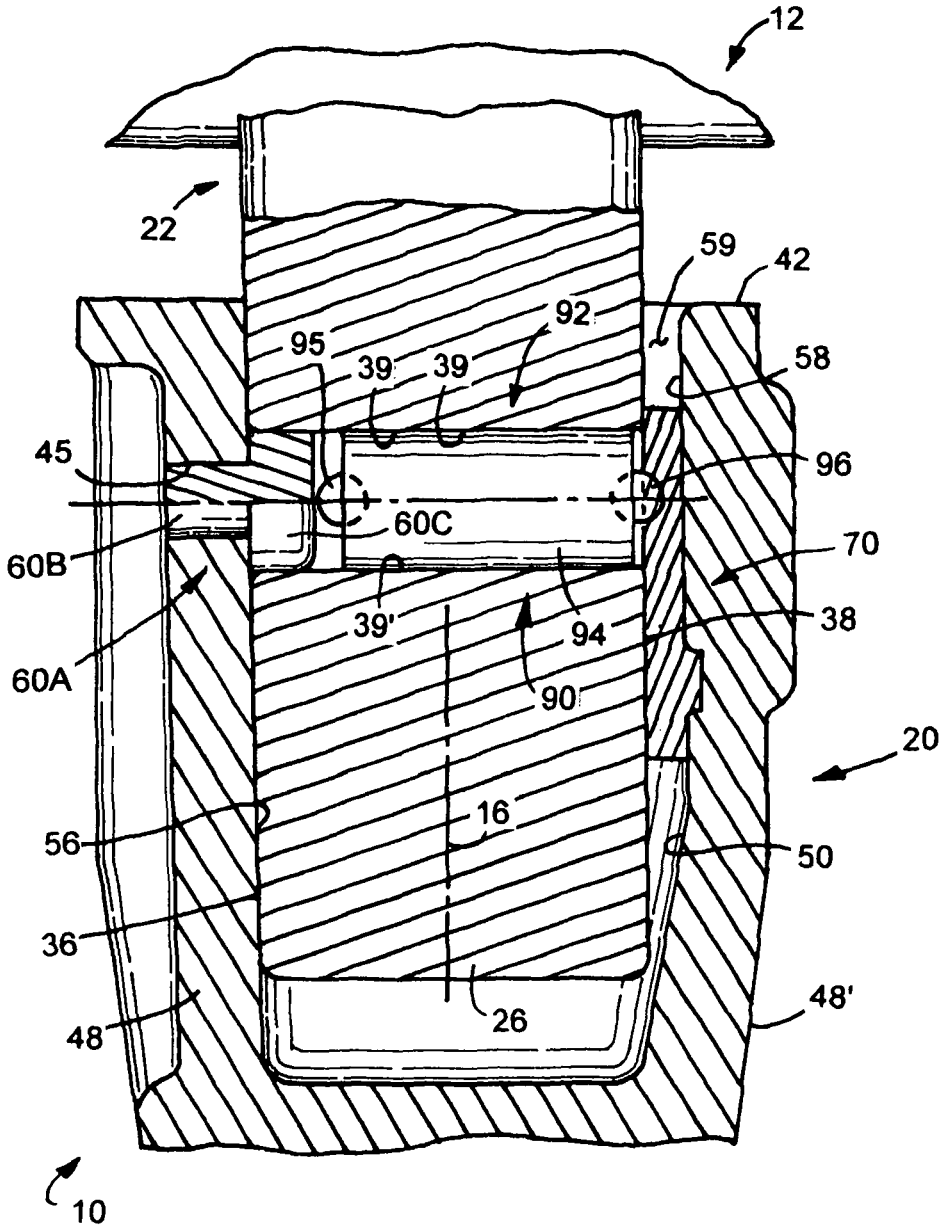
FIG. 4A is a view similar to FIG. 4 showing an alternative form of lock for holding a wear part of the tooth assembly and an adapter nose portion in operable combination.

In the alternative embodiment illustrated in FIG. 4A, a lock 60A extends into the tooth cavity 50 and toward axis 16 but is formed independent of tooth 20. As shown in FIG. 4A, tooth 20 is provided with a bore 45 in the side wall 48 forwardly from the rear end 42 of the tooth 20 and which opens to the tooth cavity 50. Preferably, bore 45 has a closed marginal edge defined by tooth 20. Bore 45 is located in general registry with the recess 39 defined by the adapter nose portion 26 when the tooth 20 is fitted in operable combination on the adapter nose portion 26.

In this alternative embodiment, lock 60A includes a shank portion 60B and an axially aligned head portion 60C. Shank portion 60B of lock 60A is received and secured against axial movements within bore 45 in the tooth side wall 48 through any suitable and well known means. As shown in FIG. 4A, the head portion 60C of lock 60A extends into the socket 50 in general registry with the adapter nose portion recess 39 when the tooth 20 and adapter nose portion 26 are in operable combination relative to each other. Preferably, the cross-sectional configuration of head portion 60C on lock 60A is equal to or smaller than the cross-section of the recess 39 defined by the adapter nose portion 26. Like lock 60, the lateral distance separating the free end of the head portion 60C from the opposed side surface 58 of tooth cavity 50 is greater than the lateral distance separating opposed sides 36 and 38 of the adapter nose portion 26 whereby permitting longitudinal translation of the adapter nose portion 26 relative to the tooth socket 50 and past lock 60A. During operation, the working loads and forces encountered by tooth assembly 10 are advantageously transferred from the digging tooth 20 to the adapter 22 through the lock 60A extending into the recess 39 on the adapter nose portion 22.

From an understanding of this disclosure, it will be appreciated that locks 60 and 60A serve the same functional purpose and operate in the same way to secure the tooth 20 and adapter nose portion 26 in operable combination. As such, the description below will only reference lock 60 for operably and releasably securing the tooth 20 and adapter nose portion in operable combination but it should be appreciated lock 60 could have a design similar to lock 60A without detracting or departing from the true spirit and scope of this invention disclosure.

In accordance with the present disclosure, each tooth assembly 10 is furthermore provided with a spacer or securement member 70. Securement member 70 is insertable into the relief or space 59 defined between the confronting surfaces on the adapter nose portion 26 and tooth cavity 50 so as to at least partially fill the relief 59 and urge the tooth in a direction toward lock 60 thereby maintaining the lock 60 within the recess 39 in the adapter nose portion 26 so as to inhibit longitudinal translation of the tooth 20 relative to the adapter nose portion 26. Preferably, securement member 70 extends in a direction relative to the longitudinal axis 16 of the tooth assembly 10 so as to advantageously avoid operating loads being applied directly thereto during operation of the digging tooth assembly 10.

After the tooth 20 is arranged in operable combination with adapter 22, a portion of securement member 70 fits between the exterior of adapter nose portion 26 and the interior of the tooth socket 50 opposite from lock 60. By this design, member 70 advantageously avoids operating loads being applied directly thereto during operation of the digging tooth assembly 10. As such, wear on securement member 70 is minimized thus allowing securement member 70 to be reused, if desired, when a replacement part 20 is again attached to adapter 22.

In the form shown in FIGS. 6 through 9, the securement member or spacer 70 includes an enlarged head portion 72 and a shank portion 74. Member 70 is preferably formed from metal, i.e. steel or other suitable material or non-compressible metal alloy, with the head portion 72 and shank portion 74 preferably being formed integral relative to each other. In the illustrated form shown in FIGS. 2 and 3, the exposed section of the head portion 72 of member 70 generally follows the fore-and-aft profile of tooth 20 to promote movement of material therepast.

Returning to the embodiment illustrated by way of example in FIGS. 6 through 9, shank portion 74 of member 70 preferably includes two laterally spaced and generally parallel sides 76 and 78. Notably, the distance between the sides 76 and 78 of as well as the configuration of the shank portion 74 can change from one securement member to another depending upon the particular tooth socket and adapter nose portion combination or conjuncture into which the member 70 is to be inserted. The wear part or tooth 20 is secured to the adapter 22 by the lock 60. In this embodiment, tolerances of the shank portion 74 of member 70 are generally controlled by the distance between the side surfaces 56 and 58 of the tooth socket 50. Thus, the combination of lock 60 with the securement member 70 allows the system of this invention disclosure to be used on scores of other manufacturers' adapters, even though the tolerances of those other manufacturers' adapters are not ascertainable with exacting certainty.

To reduce an accumulation of dirt fines between the tooth 20 and securement member 70 during operation of the tooth assembly, and thereby facilitate removal of member 70 from between tooth 20 and adapter nose portion 26, the shank portion 74 or member 70 preferably has an arcuate configuration between the free distal thereof and that end joined to the head portion 72. Additionally, and after the adapter nose portion 26 is arranged in operable combination with tooth 20, the shank portion 74 of member 70 preferably extends across substantially an entire side of the adapter nose portion 26 when member 70 is fully inserted into an operational position whereby furthermore reducing stress concentrations during operation of the digging tooth assembly 10 (FIG. 1).

Figure 6:
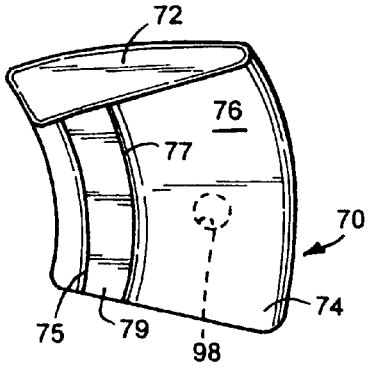
FIG. 6 is a side view of one form of securement member used in connection with the present disclosure.
Figure 7:
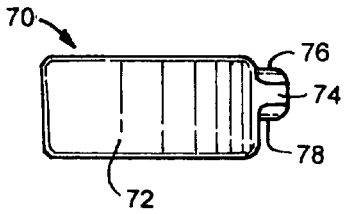
FIG. 7 is a top plan view of the securement member shown in FIG. 7.
Figure 8:
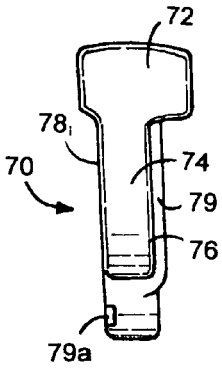
FIG. 8 is an elevational view of the securement member shown in FIG. 7.
Figure 9:
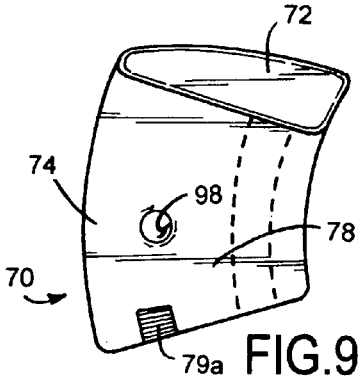
FIG. 9 is another side view of the securement member shown in FIG. 7.

In the form shown in FIGS. 6 and 9, the spacer or member 70 furthermore includes an elongated key 79 projecting from side 76 of the shank portion 74. The other side 78 of the shank portion 74, i.e. the side arranged in confronting relation with the side of the adapter nose portion 26, preferably has a generally planar surface configuration. For reasons discussed in further detail below, the side 78 of member 70 preferably has a camming surface 79*a* to effectively reduce the lateral width leading from the terminal end of the shank portion 74 of member 70.

In one form, the key 79 on the shank portion 74 of member 70 has an arcuate configuration between opposed ends and extends at least the majority and preferably the entire length of the shank portion 74 of member 70. The arcuate configuration of the key 79 preferably compliments the arcuate configuration of the shank portion 74 of member 70 and advantageously limits the direction which member 70 can be correctly inserted into operable combination with the tooth 20 and adapter nose portion 26.

Figure 10:
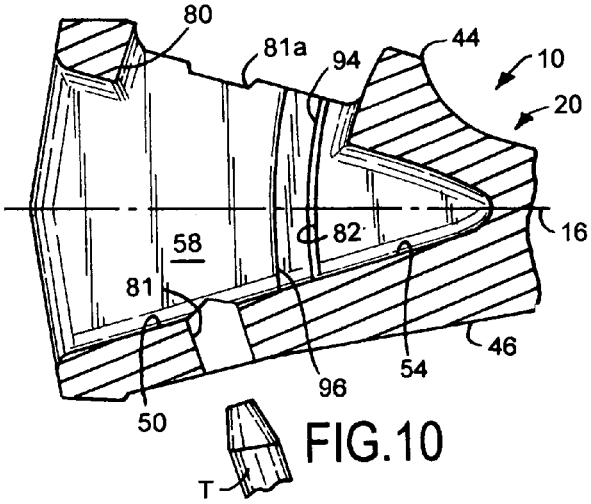
FIG. 10 is a sectional view taken along line 10-10 of FIG. 4.

In the example shown in FIG. 10, the upper or top slanted wall 44 of the wear part or tooth 20 defines an opening 80 arranged adjacent to the side surface 58 of and extending through to the blind cavity or socket 50 of the tooth 20. Notably, in the example illustrated in FIG. 10, the opening 80 defined by tooth 20 is arranged adjacent to that side surface 58 of the blind cavity 50 opposite from lock 60 (FIGS. 4 and 5). The opening 80 in the tooth 20 permits the shank portion 74 of member 70 (FIGS. 7 through 9) to pass endwise therethrough while limiting movement of the enlarged head portion 72 from passing therethrough. As such, the marginal edge of the opening 80 acts as a limit stop for member 70.

In the embodiment illustrated in FIG. 10, an opening 81 in the lower or bottom wall 46 of wear part 20 proximate to the side surface 58 of cavity 54 permits passage of a suitably shaped tool T therethrough so as to engage and push upwardly against member 70 (FIGS. 6 through 9) whereby facilitating removal of member 70, when required or desired, from the space or relief 59 between wear part 20 and the adapter nose portion 26 to effect repair/replacement of the wear part 20. Passage of tool T through opening 81 on tooth 20 will cause vertical displacement of the member 70 through the tooth opening 80. Only after member 70 is removed from between the tooth 20 and adapter nose portion 26 can the wear part 20 be shifted whereby releasing the adapter nose portion 26 from operable engagement with the lock 60 (FIG. 4) on the tooth 20 and thereafter permitting the longitudinal translation of the tooth 20 relative the adapter nose portion 26 to effect release of the tooth 20 from adapter 22.

Returning to FIG. 3, when securement member 70 is fully inserted into operable combination with the tooth 20 and adapter 22, a portion of the head portion 72 of member 70 overlies and is arranged in confronting relation relative to a portion of tooth 20. As shown in FIGS. 3 and 10, a slot or other suitably shaped recess 81*a* extends to the exterior of tooth 20 from a marginal edge of the opening 80. Besides those steps mentioned above for effecting release of member 70 from engagement with the tooth 20 and adapter 22, opening 81*a* furthermore allows a suitably shaped tool (not shown) to be inserted between the head portion 72 of member 70 and that portion of the tooth 20 arranged in confronting relation relative thereto to effect separation between member 70 and tooth 20 whereby effecting release of the member 70.

Figure 11:
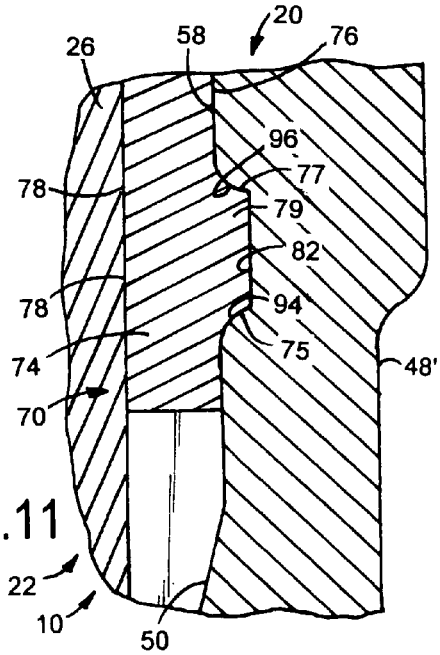
FIG. 11 is an enlarged view of the area encompassed in phantom lines in FIG. 4.

Turning to FIGS. 10 and 11, the side surface 58 of tooth cavity 50 opposite from the lock 60 (FIG. 4) preferably defines an arcuately shaped keyway 82 for slidably accommodating and guiding endwise passage of the key 79 therethrough when the shank portion 74 of member 70 is inserted into operable combination with the tooth 20 and adapter 22. As shown in FIGS. 10 and 11, the keyway 82 defines longitudinally spaced shoulders 94 and 96 which cooperate with the longitudinally spaced sides 75 and 77 on key 79 to allow the securement member 70 to interact with the tooth 20 while maintaining and orienting the shank portion 74 of the member 70 relative to the tooth 20. In a preferred form, member 70 has only one way of being inserted into operable combination with the adapter nose portion 26 and tooth 20. It should be appreciated, however, the arrangement of key 79 and keyway 82 could readily be reversed. That is, key 79 can be provided on the side surface of the tooth cavity 50 while the keyway 82 can be provided on the side 78 of the shank portion 74 without detracting or departing from this invention disclosure.

Preferably, a secondary lock 90 is provided for releasably maintaining member 70 in position between tooth 20 and the adapter nose portion 26 during operation of the tooth assembly whereby inhibiting inadvertent longitudinal separation of the tooth 20 relative to the adapter 22. More specifically, and in the example shown in FIG. 4, the secondary lock 90 is arranged in operable combination with the digging tooth 20, the adapter nose portion 26, and member 70. It will be appreciated, however, and as discussed below, the secondary lock 90 can take varied configurations without detracting or departing from the spirit and scope of the present disclosure.

Figure 12:
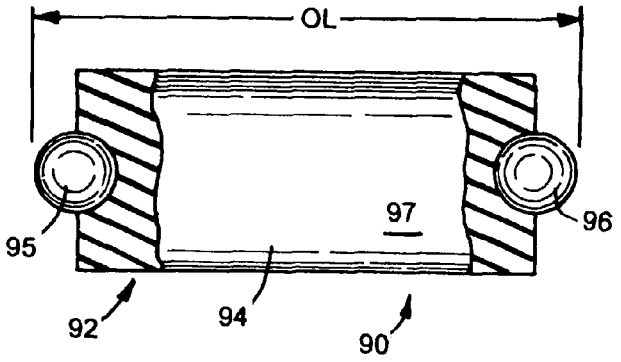
FIG. 12 is an enlarged top plan view, partly in section, showing part of a secondary lock for use in combination with this invention disclosure.
Figure 13:
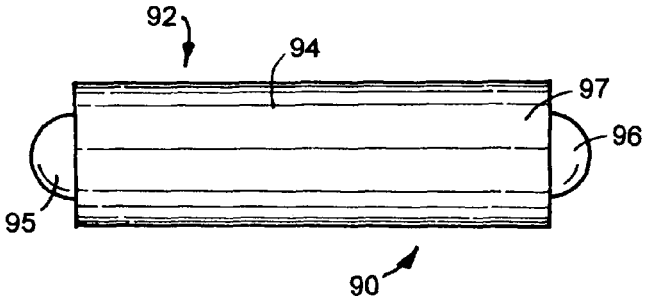
FIG. 13 is an elevational view of the part illustrated in FIG. 12.
Figure 14:
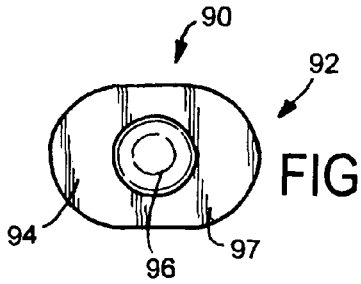
FIG. 14 is an end view of the part illustrated in FIG. 12.

In the embodiment shown in FIG. 4, the secondary lock 90 is designed as a detent mechanism 92 for releasably maintaining member 70 between the tooth 20 and the adapter nose portion 26 during operation of the digging tooth assembly 10. More specifically, and as shown in FIGS. 12, 13 and 14, mechanism 92 includes a spring 94 preferably having a semi-spherical element 95 and 96 longitudinally projecting from each end thereof. Suffice it to say, the operative length OL of mechanism 92 (FIG. 12) is greater than the lateral distance between the distal end of tooth projection 60 and the planar side surface 78 of lock 70 (FIG. 4). As such, and when the securement member 70 is inserted between the tooth 20 and the adapter nose portion 26, and the secondary lock 90 is arranged in the position shown in FIG. 4, spring 94 is longitudinally compressed such that the elements 95 and 96 are continually urged in opposed longitudinal directions relative to each other.

Figure 15:
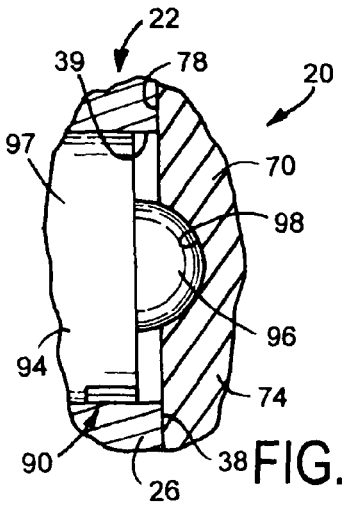
FIG. 15 is an enlarged sectional view of the area encompassed by dash lines in FIG. 4.

In the embodiment shown in FIG. 4, spring 94 is designed as a longitudinally compressible elastomeric member 97. Alternatively, however, a conventional mechanical or coil spring can be used as part of mechanism 92. In the illustrated embodiment, the elastomeric member 97 fits into the recess or bore 39 in the adapter nose portion 26 (FIGS. 4 and 15). Moreover, elements 95 and 96 are preferably designed as metal, i.e., steel, ball bearings which extend longitudinally from and are secured, as by vulcanization or other suitable process, to opposed ends of the elastomeric spring 94, such that about half of each ball bearing 95, 96 extends beyond the respective free end of the spring 94. By this design, mechanism 92 can be inserted into the bore 39 in the adapter nose portion 26 with elements 95, 96 longitudinally extending from either end thereof without detracting from the effective and efficient operation of lock 90. Moreover, and with the secondary lock embodiment illustrated in FIGS. 4 and 12 through 15, the secondary lock 90 advantageously cannot be incorrectly installed into operable combination with the tooth 20, adapter nose portion 26 and member 70.

As shown by way of example in FIGS. 4 and 15, and when lock 90 is arranged in operable combination with the digging tooth 20, the adapter nose portion 26, and member 70, element 96 is urged by spring 94 into a suitably configured recess 98 defined on the generally planar face of side surface 78 of member 70. As will be understood, during insertion of member 70 into the space 59 between the wear part 20 and the adapter nose portion 26, spring 94 initially and longitudinally compresses to permit the shank portion 74 of member 70 to pass element 96. In this regard, and as member 70 is being inserted into the recess 59 between the wear part 20 and the adapter nose portion 26, the ramp or camming surface 79*a* (FIG. 9) on member 70 progressively compresses the spring 94 whereby easing installation of the secondary lock 90 and reducing the likelihood of damage to element 96 of the secondary lock 90.

Continued insertion of the securement member 70 into the space or void 59 separating side 38 of the adapter nose portion 26 from the side surface 58 of tooth cavity 50 eventually causes the recess 98 on the face 78 of lock 70 to align with element 96, acting under the compression of spring 94, whereby causing element 96 to forcibly snap into and engage the recess 98 thereby inhibiting inadvertent removal of member 70 from between the tooth 20 and the adapter nose portion 26. The resiliency of the secondary lock 90, however, furthermore permits purposeful removal of the securement member 70 from between the tooth 20 and adapter nose portion 26 whereby permitting repair and/or removal of the wear part 20 when required or desired without the use of hammers or the like.

Furthermore, the design of mechanism 92 could readily be altered without detracting or seriously departing from the true spirit and scope of this disclosure. That is, and if so desired, mechanism 92 could be designed with but a single detent 96 at only one end of the spring 94 so as to coact with recess 98 on the side surface 78 of lock 70. Alternatively, a spherical projection 96 can be provided on side surface 78 of member 70, with the accommodating recess 98 for releasably holding that element 96 being provided at the end of the spring 94.

As mentioned, the secondary lock for maintaining member 70 between tooth 20 and the adapter nose portion 26 can take varied configurations without detracting or departing from the spirit and scope of the present disclosure. In this regard, an alternative secondary lock arrangement is illustrated by way of example in FIGS. 16 and 17. This alternative form of secondary lock is designated generally by reference numeral 190. The elements of wear part 20, the adapter nose portion 26, and securement member 70 which are similar to those mentioned above are identified by like reference numerals.

Figure 16:
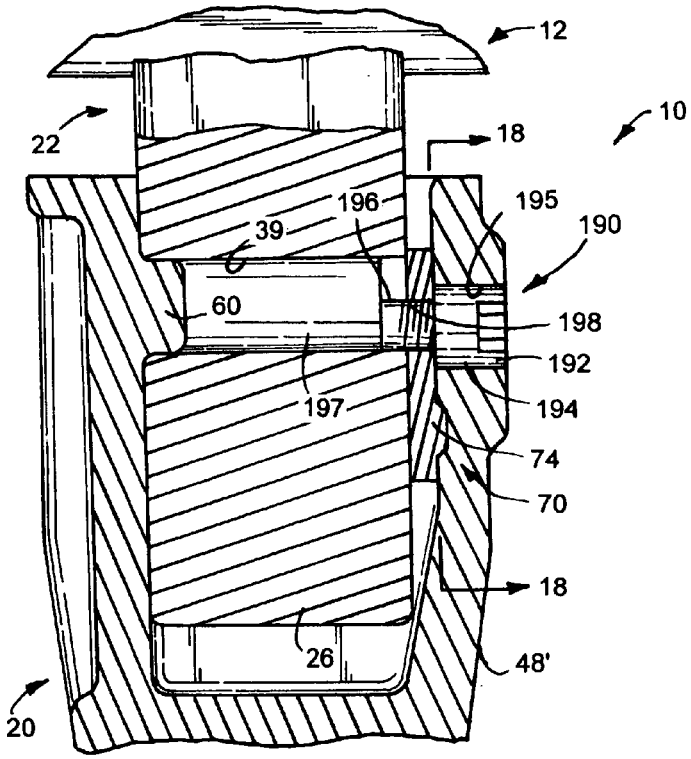
FIG. 16 is a view similar to FIG. 4 showing an alternative secondary lock for use in combination with this invention disclosure.

In that embodiment shown in FIG. 16, the secondary lock 190 includes an elongated member 192 having an enlarged head portion 194 and a shank portion 196. At least a lengthwise section of the shank portion 196, axially extending from the head portion 194 of member 192, is provided with external threading thereon. Moreover, and as illustrated by way of example in FIGS. 16 and 17, the head portion 194 of member 192 is configured to accommodate a tool (not shown) suitable for imparting rotation to member 192 from outside the tooth or wear part 20.

Figure 18:
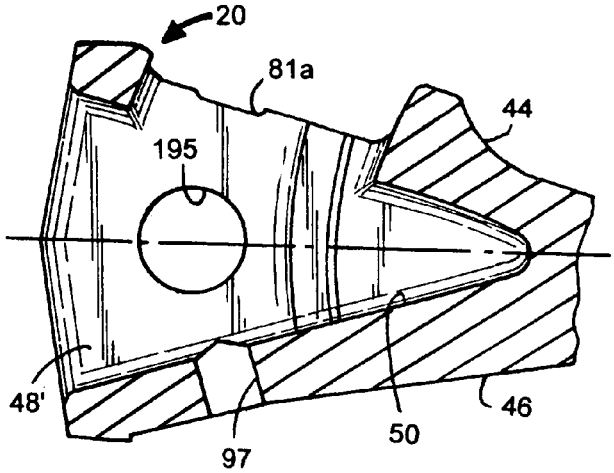
FIG. 18 is a view similar to FIG. 10 showing a preferred design of the digging tooth to accommodate the secondary lock shown in FIGS. 16 and 17.

When wear part 20 and the adapter nose portion 26 are arranged in operable combination with each other, and in example shown in FIG. 16, the head portion 194 and shank portion 196 of member 192 extend endwise through a bore 195 (FIGS. 17 and 18) provided in the tooth side wall 48'. As such, the head portion 194 of member 192 is preferably accommodated within the confines defined by the closed margin of the bore 195 on the side wall 48' of tooth 20 and protected against wear during operation of tooth assembly 20.

Figure 19:
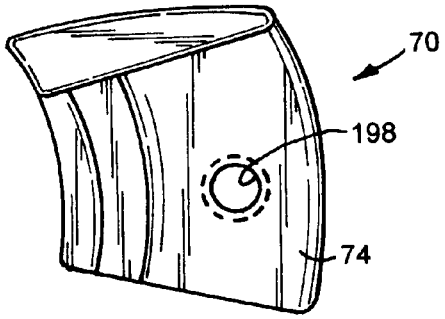
FIG. 19 is a view similar to FIG. 6 showing an alternative design for the securement member to accommodate the secondary lock shown in FIGS. 16 and 17.

In the example illustrated in FIG. 16, and when member 192 is inserted fully into operable combination with wear part 20 and adapter nose portion 26, the free end of the shank portion 196 of member 192 axially extends into the recess 39 in the adapter nose portion 26 thereby furthermore inhibiting inadvertent longitudinal translation of the tooth 20 relative to the adapter nose portion 26. In the example shown, and to inhibit inadvertent separation of member lock 70 from between tooth 20 and the adapter nose portion 26, the threaded shank portion 196 of member 192 threadably engages with a threaded opening 198 (FIG. 19) extending through the shank portion 74 of securement member 70. As such, the securement member 70 is maintained in position between the tooth 20 and adapter 22 by the secondary lock 190 thereby releasably maintaining the tooth 20 and adapter 22 in operable combination with each other until the secondary lock 190 is removed from operable association with securement member 70.

To add strength and rigidity to that section of the adapter nose portion 26 defining the bore 39, the secondary lock 190 can further include a metal, preferably steel, insert 197 between the free end of lock 60 and the distal end of the threaded shank portion 196 of member 192. Preferably, insert 197 would have a cross-sectional configuration which is close to the cross-sectional configuration of bore 39 defined by the adapter nose portion 26. Moreover, the insert 197 would have a length generally equal to the length separating the free end of lock 60 from the distal end of the threaded shank portion 196 of member 192 when member 192 is fully engaged with the securement member 70 so as to furthermore and advantageously limit displacement and movements of the wear part/tooth 20 on the adapter nose portion 26 during operation of the digging tooth assembly 10.

Figure 20:
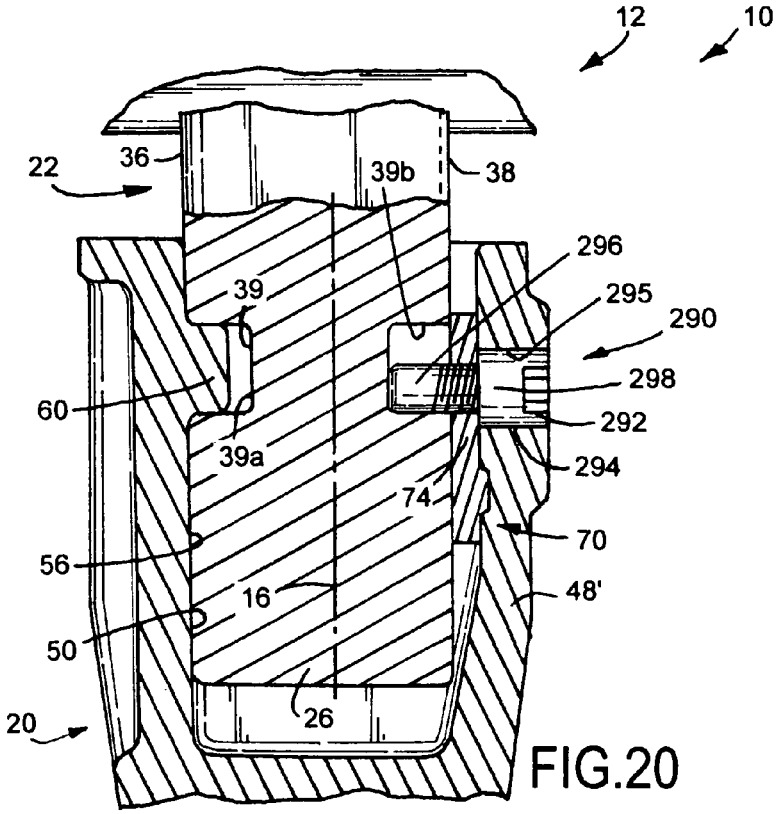
FIG. 20 is a view similar to FIG. 4 showing another alternative secondary lock for use in combination with this invention disclosure.

Another alternative secondary lock arrangement is illustrated by way of example in FIG. 20. This alternative form of secondary lock is designated generally by reference numeral 290. The elements of wear part 20, the adapter nose portion 26, and securement member 70 which are similar to those mentioned above are identified by like reference numerals.

In the embodiment shown in FIG. 20, the recess or bore 39 disposed toward the rear of the adapter nose portion 26 is defined by a pair of axially aligned blind bores 39*a* and 39*b*. Each void or opening 39*a* and 39*b* opens to a respective side 36 and 38 of the adapter nose portion 26. Moreover, each void or opening 39*a* and 39*b* preferably has a closed marginal edge; with the blind bore 39*a* being configured to endwise accommodate the lock 60 on tooth 20.

In the embodiment illustrated in FIG. 20, the secondary lock 290 includes an elongated member 292 having an enlarged head portion 294 and a shank portion 296. At least a lengthwise section of the shank portion 296 axially extending from the head portion 294 of member 292 is provided with external threading thereon. As with the secondary lock embodiment illustrated in FIGS. 16 and 17, the head portion 294 of member 292 is configured to accommodate a tool (not shown) suitable for imparting rotation to member 292 from outside the tooth or wear part 20.

When wear part 20 and the adapter nose portion 26 are arranged in operable combination with each other, and in example shown in FIG. 20, the head portion 294 and shank portion 296 of member 292 extend endwise through a bore 295 (similar to bore 195 illustrated in FIGS. 17 and 18) provided in the tooth side wall 48'. As such, the head portion 294 of member 292 is preferably accommodated within the confines defined by the closed margin of the bore 295 on the side wall 48' of tooth 20 and is protected against wear during operation of tooth assembly 20.

When member 292 is inserted fully into operable combination with wear part 20 and adapter nose portion 26, a lengthwise portion of shank portion 296 of member 292 axially extends through the securement member 70 and into the recess 39*b* in the adapter nose portion 26 thereby furthermore inhibiting inadvertent longitudinal translation of the tooth 20 relative to the adapter nose portion 26. In this embodiment, the shank portion 296 of member 292 is sized such that the free end thereof engages with and presses against the closed end of the blind cavity 39*b* whereby advantageously laterally moving the tooth 20 relative to the adapter nose portion 26 and in a direction whereby further securing lock 60 on tooth 20 within the blind cavity 39*a* on the other side of the adapter nose portion 26.

In the example shown in FIG. 20, and to inhibit inadvertent separation of member 292 from securement member 70, the threaded shank portion 296 of member 292 engages with an opening 298 (similar to opening 198 illustrated in FIG. 19) extending through the shank portion 74 of member 70. As such, securement member 70 is maintained in position between the tooth 20 and adapter 22 by the secondary lock 290 thereby releasably maintaining the tooth 20 and adapter 22 in operable combination with each other until the secondary lock 290 is removed from operable association with securement member 70.

Figure 21:
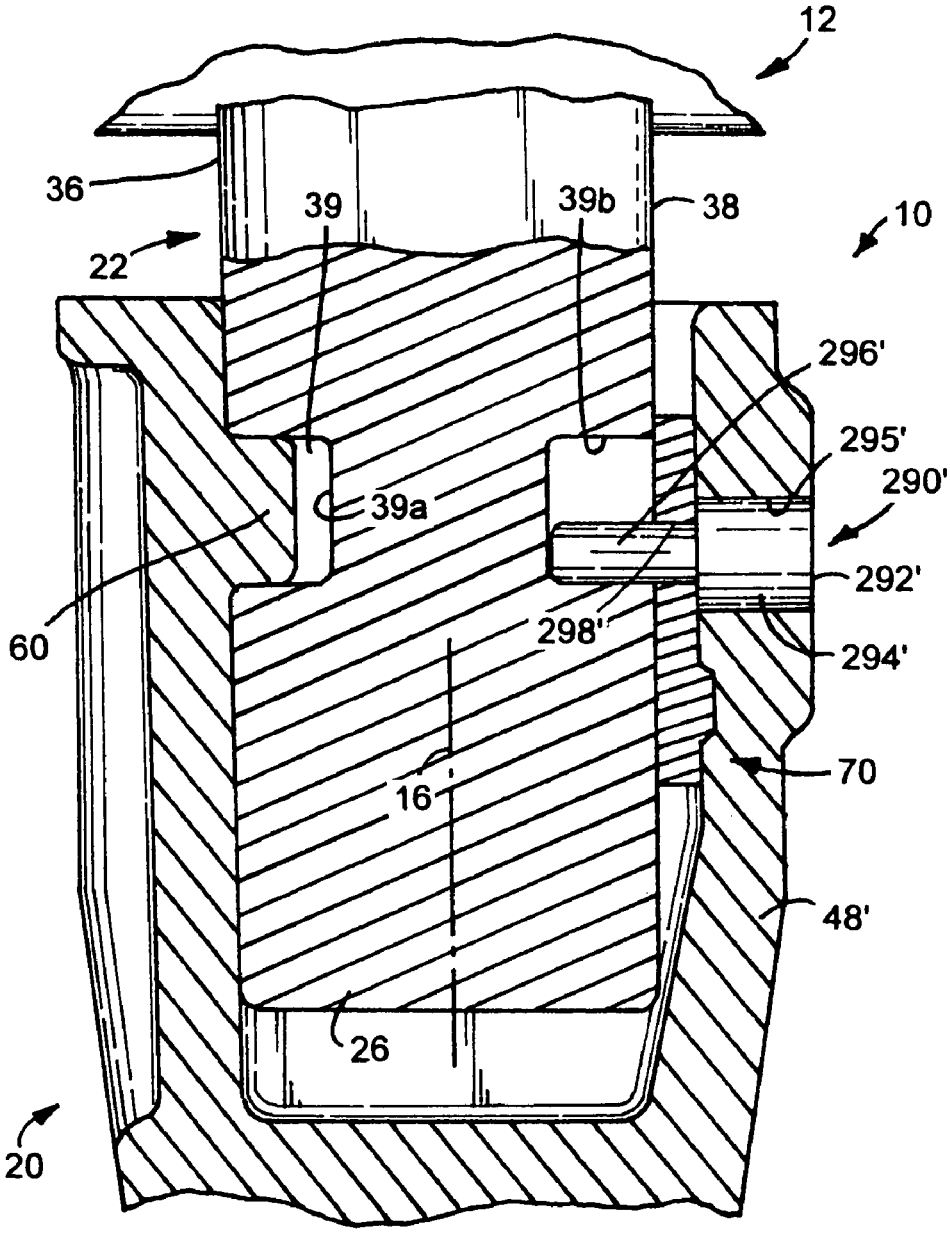
FIG. 21 is also a view similar to FIG. 4 showing another alternative secondary lock for use in combination with this invention disclosure.

Yet another alternative secondary lock arrangement is illustrated by way of example in FIG. 21. Because of the similarity with lock 290, this alternative form of secondary lock is designated generally by reference numeral 290'. The elements of wear part 20, the adapter nose portion 26, and securement member 70 which are similar to those mentioned above are identified by like reference numerals.

Turning to FIG. 21, and as in the embodiment shown in FIG. 20, the recess or bore 39 disposed toward the rear of the adapter nose portion 26 is defined by a pair of axially aligned blind bores 39*a* and 39*b*. Each void or opening 39*a* and 39*b* opens to a respective side 36 and 38 of the adapter nose portion 26. Moreover, each void or opening 39*a* and 39*b* preferably has a closed marginal edge. In the example shown, the blind bore 39*a* is configured to endwise accommodate the lock 60 on tooth 20.

In the embodiment illustrated in FIG. 21, the secondary lock 290' includes an elongated member 292' preferably having an enlarged head portion 294' and a shank portion 296'. In this embodiment, either the whole or part of member 292 is formed from a magnetic material. Although substantially any magnetic material would suffice, forming member 292' from a magnetic material including neodymium and of the type sold by K&J Magnetics, Inc. in Jamison, Pa. 18929 has been found to be particularly beneficial.

When wear part 20 and the adapter nose portion 26 are arranged in operable combination with each other, and in example shown in FIG. 21, the head portion 294' and shank portion 296' of member 292' extend endwise through a bore 295' (similar to bore 195 illustrated in FIGS. 17 and 18) provided in the tooth side wall 48'. As such, the head portion 294' of member 292' is preferably accommodated within the confines defined by the closed margin of the bore 295' on the side wall 48' of tooth 20 and is protected against wear during operation of tooth assembly 20.

When member 292' is inserted fully into operable combination with wear part 20 and adapter nose portion 26, a lengthwise portion of shank portion 296' of member 292' axially extends through an opening 298' in the securement member 70 (similar to opening 198 illustrated in FIG. 19) and into the recess 39*b* in the adapter nose portion 26 thereby furthermore inhibiting inadvertent longitudinal translation of the tooth 20 relative to the adapter nose portion 26. The magnetic material from which member 292' is formed inhibits inadvertent separation of member 292' from securement member 70 and tooth 20. As such, securement member 70 is maintained in position between the tooth 20 and adapter 22 by the secondary lock 290' thereby releasably maintaining the tooth 20 and adapter 22 in operable combination with each other until the secondary lock 290 is removed from operable association with securement member 70.

To remove member 292', a portion of the head portion 294 of member 292 facing the side 48' of tooth 20 can be suitably configured so as to allow a tool (not shown) to engage therewith whereby effectively removing member 292' from the tooth 20. Alternatively, another magnet can be used to effectively and magnetically withdraw member 282' axially from bore 295' so as to effectively release member 292' from securement member 70 whereby effecting the release of the tooth 20 from the adapter nose portion 26.

Figure 22:
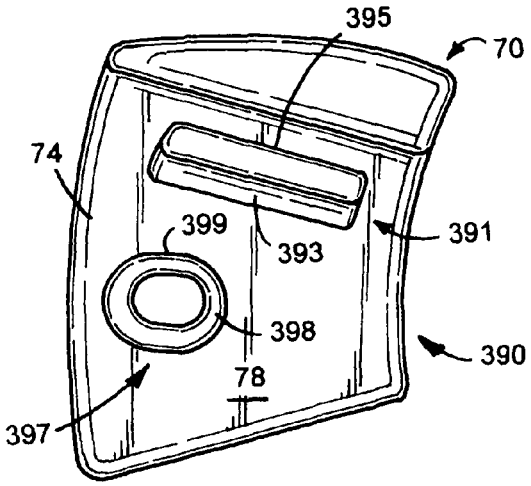
FIG. 22 is an enlarged view of a securement member similar to FIG. 9 showing another alternative secondary lock design.
Figure 23:
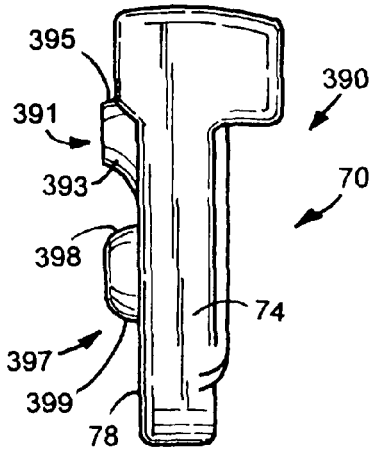
FIG. 23 is an elevational view of the securement member illustrated in FIG. 21.
Figure 24:
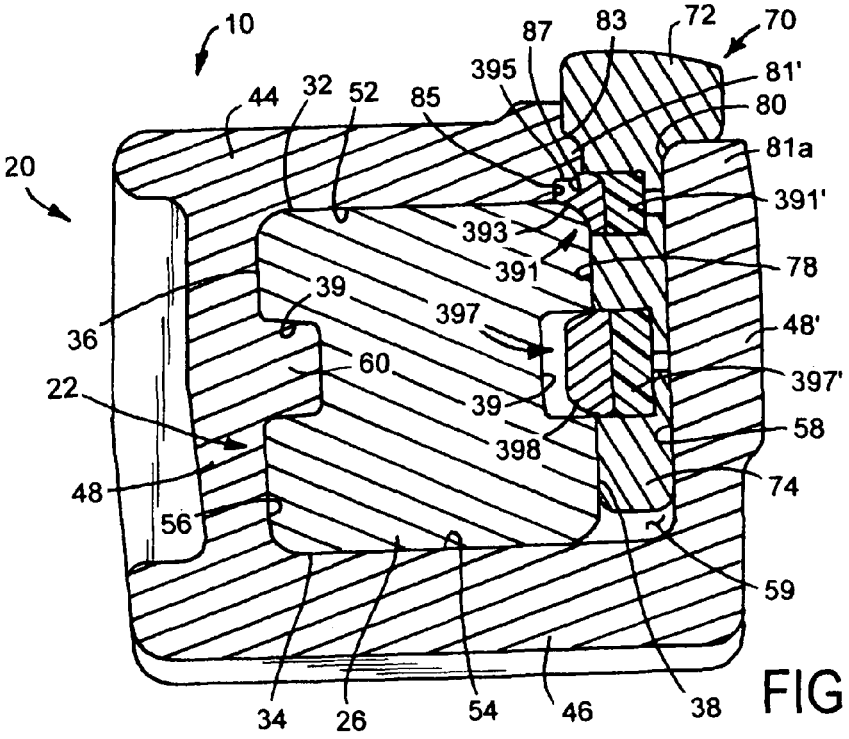
FIG. 24 is an enlarged transverse sectional view illustrating the securement member shown in FIGS. 21 and 22 in operable combination with a tooth assembly according to the present disclosure.

Yet another alternative secondary lock arrangement for maintaining securement member 70 in operable association with and between tooth 20 and adapter nose portion 26 is illustrated by way of example in FIGS. 22, 23 and 24. This alternative form of secondary lock is designated generally by reference numeral 390. The elements of wear part 20, the adapter nose portion 26, and securement member or lock 70 which are similar to those mentioned above are identified by like reference numerals.

This form of secondary lock 390 is preferably carried by the securement member 70 having a design substantially similar to that discussed above. Accordingly, the same reference numerals will be used for securement member 70 as were used above. As shown in FIGS. 22 and 23, this alternative form of secondary lock 390 is designed as a detent mechanism and preferably includes a resiliently biased elongated detent 391 extending longitudinally across and laterally from side 78 of the shank portion 74 of member 70 adapted to be arranged in confronting relation relative to the adapter nose portion 26 when member 70 is inserted into operable combination with tooth 20 (FIG. 24). While the free end of detent 391 laterally extends from the shank portion 74 of member 70, it is to be understood detent 391 is preferably captured and carried by the shank portion 74 of member 70. Moreover, detent 391 is preferably configured with a chamfferred lower surface or edge 393 and an upper edge 395. Edge 395 preferably extends generally normal to that side 78 of the shank portion 74 of the member 70 adapted to be arranged in confronting relation relative to the adapter nose portion 26 when member 70 is inserted into operable combination with the tooth 20 (FIG. 24).

Detent 391 of lock 390 is permitted to initially move inwardly toward that side 78 of the shank portion 74 of member 70, adapted to be arranged in confronting relation relative to the adapter nose portion 26, when member 70 is inserted between the tooth 20 and the adapter nose portion 26 (FIG. 24). When the securement member 70 is fully inserted unto operable combination with the tooth 20 and the adapter nose portion 26, detent 391 springs back to the position shown in FIG. 24 under the influence of a resilient member 391'.

In the embodiment shown in FIG. 24, a marginal edge of the opening 80 in the upper slanted wall 44 of tooth 20 is provided with a longitudinally elongated and free ended lip 81'. Notably, the free end of lip 81' is arranged in general vertical alignment with the side 38 of the adapter nose portion 26 when the tooth 20 and adapter 22 are arranged in operable combination relative to each other. In the illustrated embodiment, tooth 20 further defines a chamffered or angled surface 83 extending upwardly and laterally from the free end of the lip 81' toward an upper surface on the upper tooth wall 44. In the illustrated embodiment, tooth 20 further defines an undercut or recess 85 extending laterally from the free end of the lip 81' and defining a shoulder 87 extending at an angle of about 90° relative to the free end of the lip 81'.

Returning to FIGS. 22 and 23, this alternative form of secondary lock 390 can furthermore include a second resiliently biased detent 397 laterally extending from side 78 of the shank portion 74 of securement member 70 in vertically spaced relation from detent 391. Detent 397 is adapted to be arranged in confronting relation relative to the adapter nose portion 26 when member 70 is inserted into the space 59 between the adapter nose portion 26 and tooth 20 (FIG. 24). Preferably, detent 397 has a button-like configuration with a chamffered outer edge 398. Like detent 391, detent 397 is captured and carried by the securement member 70 and operates under the influence of a resilient member 397'. As shown, detent 397 preferably has an outer diameter 399 generally equal to the outer diameter of recess 39 opening to that side of the adapter nose portion 26 to be arranged in confronting relation relative to the member 70 when the adapter nose portion 26 and tooth 20 are arranged in longitudinally locked relation relative to each other. When member 70 is inserted into the relief or space 59 between the tooth 20 and adapter nose portion 26, the resilient detent 397 first moves inward toward side 76 of member 70. After the securement member 70 is fully inserted into the relief or space 59 between tooth 20 and adapter nose portion 26 (FIG. 24), the detent 397 snaps or returns to a position, as shown in FIG. 24, under the influence of the resilient member 397'.

As shown in FIG. 24, when the securement member 70 is inserted through the opening 80 in the upper tooth wall 44 and into the space or relief 59 between tooth 20 and the adapter nose portion 26, the chamffered outer edge 398 of detent 397 engages with the upper chamffered or slanted surface 83 extending from the tooth lip 81' whereby forcibly causing the detent 397 to retract toward member 70 and move past the free ended lip 81' on the tooth 20. As member 70 is furthermore moved into the space 59 between tooth 20 and adapter 22, the chamffered lower surface 393 on detent 391 engages with the upper chamffered or slanted surface 83 extending from the tooth lip 81' whereby forcibly causing detent 391 to retract toward member 70 and move past the free ended tooth lip 81

As the securement member 70 is still furthermore inserted into the opening 80 in the upper wall 44 and into the space 59 between tooth 20 the adapter nose portion 26 and when the upper edge 395 of detent 391 moves past the free ended lip 81' on the tooth 20, the resiliency of detent 391 causes the detent 391 to spring into the undercut or recess 85 under the lip 81' whereby inhibiting the securement member 70 from inadvertently being displaced from between tooth 20 the adapter nose portion 26. Preferably, and substantially concurrently with the action of detent 391, the other resilient detent 397 springs into the recess 39 on the adapter nose portion 26 whereby furthermore securing securement member 70 against inadvertent displacement from between the tooth 20 and the adapter nose portion 26 so as to inhibit longitudinal translation of the tooth 20 relative to the adapter nose portion 26. The resiliency of the detents 391 and 397 furthermore permits removal of the securement member 70, when required or desired, from between the tooth 20 and the adapter nose portion 26 so as to effect repair/replacement of the wear part when required or desired.

Figure 25:
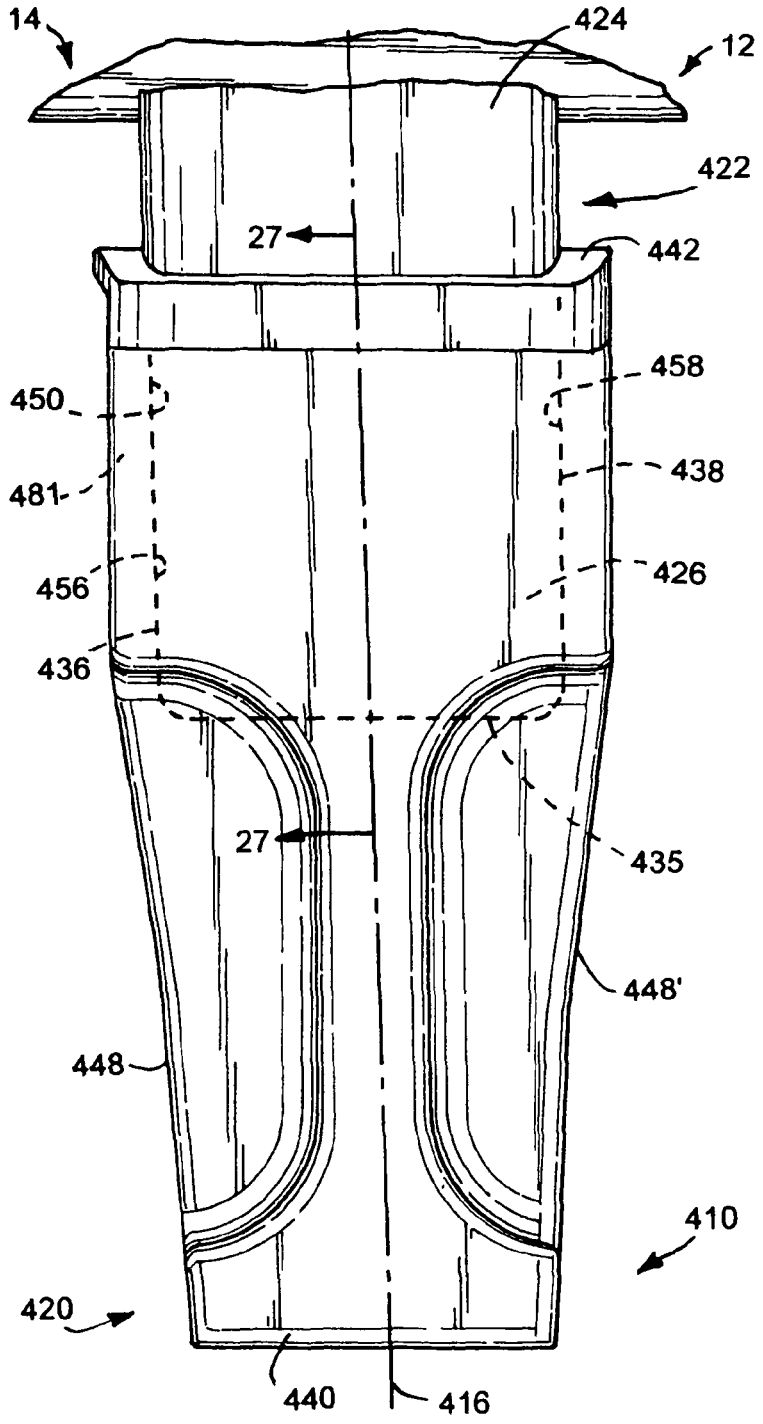
FIG. 25 is an enlarged top plan view of another form of tooth assembly.
Figure 26:
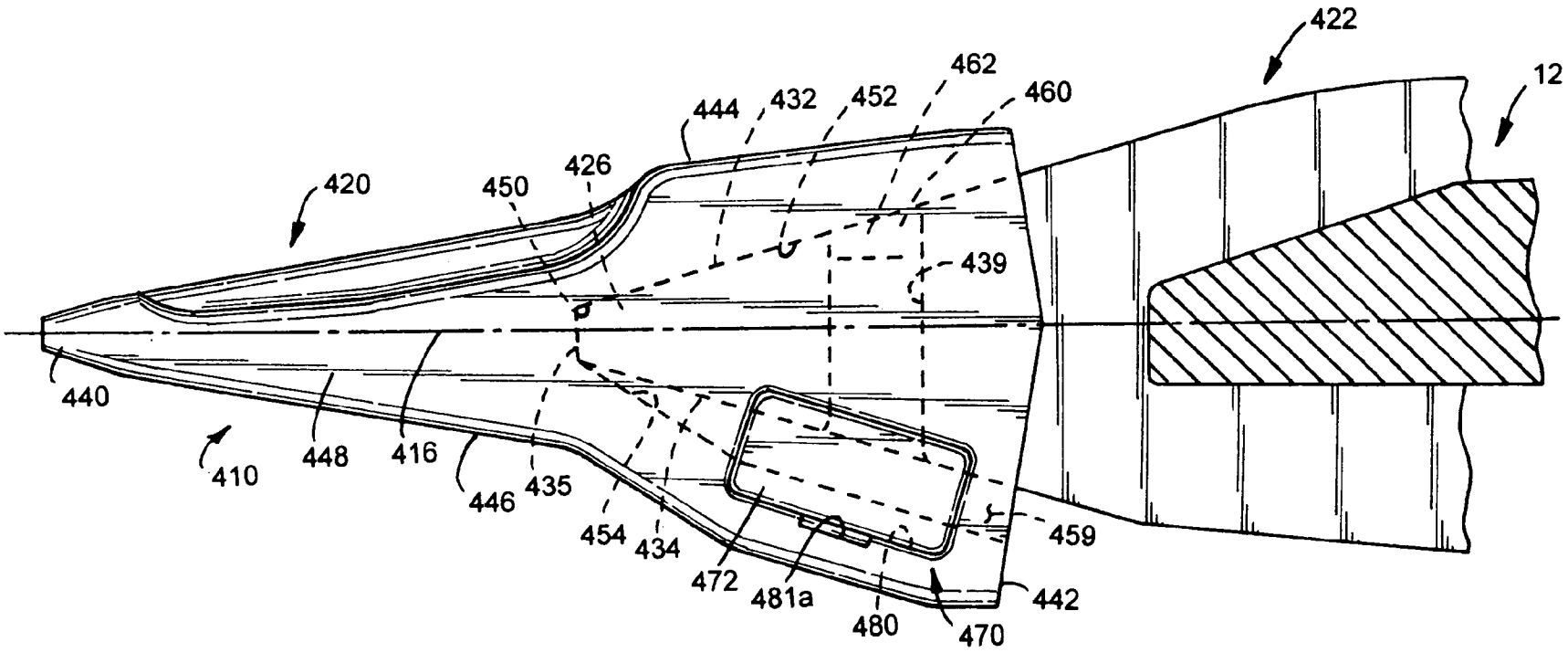
FIG. 26 is a partly sectional view of the tooth assembly shown in FIG. 25.
Figure 27:
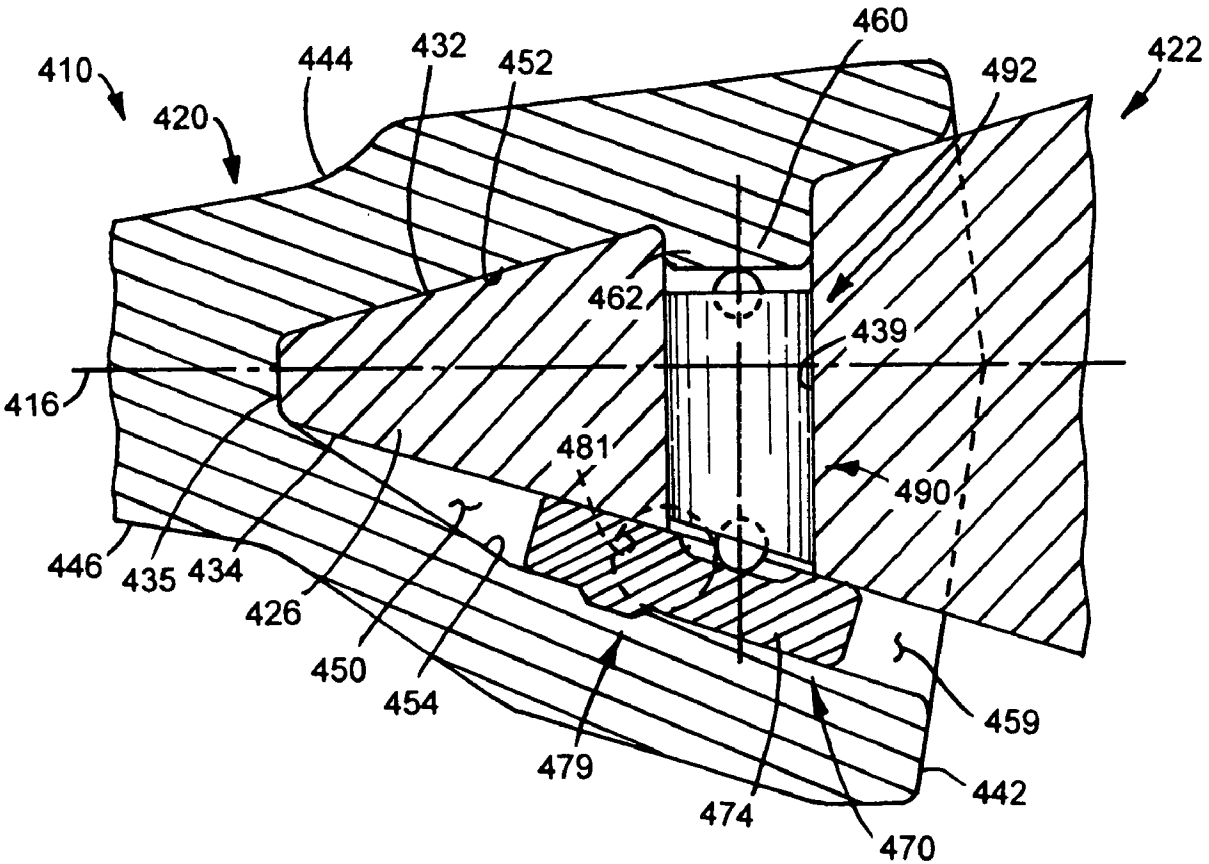
FIG. 27 is a sectional view taken along line 27-27 of FIG. 25.

FIGS. 25 through 27 illustrate another two-part tooth assembly including another form of tooth and adapter. The tooth or wear part illustrated in FIGS. 25 through 27 is designated generally by reference numeral 420. In the illustrated embodiment, the replaceable wear part 420 is designed as a digging tooth. As mentioned, however, the wear part can take any of a myriad of different designs other than a tooth, i.e., a ripper, lip shroud, wear cap, etc. without detracting or departing from the true spirit and scope of this invention disclosure. The adapter or support illustrated in FIGS. 25 through 27 is designated generally by reference numeral 422. The elements of this alternative digging tooth assembly which are functionally analogous to those components or elements discussed above regarding digging tooth 20 and adapter 22 are designated by reference numerals identical to those listed above with the exception this embodiment uses reference numerals in the 400 series.

Turning to FIG. 25, the adapter 422 has an elongated and preferably unitary construction and includes a base portion 424 and an elongated nose portion 426 projecting forward from the base portion 424. The adapter base portion 424 is configured for suitable attachment to the edge or lip 12 of the bucket or implement 14 through any suitable and well known means including fasteners, welding, etc.

The configuration of the adapter nose portion 426, illustrated by way of example in FIGS. 25 through 27, is such that a longitudinal cross-sectional configuration of the adapter nose portion 426 increases as measured rearwardly from a free end 435 of the adapter nose portion 426. In the example selected for illustrative purposes in FIGS. 26 and 27, the adapter nose portion 426 has top and bottom angled surfaces 432 and 434 which converge relative to each other and toward the free end 435 of the adapter 422. In the embodiment shown in FIG. 25, the adapter nose portion 426 furthermore includes a pair of laterally spaced sides 436 and 438 which, in the form used as an example, extend generally parallel to each other. Suffice it to say, the adapter nose portion 426 has a first predetermined configuration.

As shown in FIG. 27, the adapter or support 422 defines a recess or bore 439 disposed toward a rear of the nose portion 426 and extends generally normal to the tooth assembly axis 416. In the form shown in FIG. 27, recess 439 is defined by a vertically disposed throughbore which opens to the top and bottom surfaces 432 and 434 of the adapter nose portion 426. In the illustrated embodiment, recess 439 has a closed marginal edge.

In the example shown in FIG. 26, the wear part or tooth 420 has an longitudinally elongated wedge shape between a forward cutting edge or end 440, operative to engage the material to be worked, and a rear end 442 thereof. Like adapter 422, tooth 420 is preferably formed from a ferrous metal, i.e., steel or a steel alloy. Preferably, tooth 420 has a unitary design including an upper slanted wall 444 and a lower slanted wall 446 arranged in converging relation toward the end 440 of the tooth 420. As shown in FIG. 25, tooth 420 further includes a pair of side walls 448 and 448' between walls 444 and 446, respectively (FIG. 26). Of course, the exterior sides of tooth 420 can take a myriad of different shapes from that shown without detracting or departing from the true spirit and scope of this disclosure.

As shown in FIGS. 25 through 27, the wear part or tooth 420 defines an open-ended blind cavity or socket 450 for longitudinally receiving and accommodating at least a lengthwise section of the adapter nose portion 426. Suffice it to say, socket 450 has a predetermined configuration which compliments or proximates the configuration of the adapter nose portion 426. In the illustrated form, the socket 450 has a larger cross-sectional configuration toward an open end than toward a closed end thereof. In the illustrated embodiment, the tooth cavity or socket 450 has top and bottom angled surfaces 452 and 454 (FIGS. 26 and 27) which converge relative to each other. The tooth cavity or socket 450 furthermore includes a pair of laterally spaced side surfaces 456 and 458 which, in one form, extend generally parallel to each other and to the longitudinal axis 416. Suffice it to say, the adapter nose portion 426 and tooth cavity or socket 450 have complimentary cross-sectional designs and/or configurations.

As shown in FIGS. 26 and 27, surfaces 452 and 454 of the tooth cavity 450 are spaced or otherwise separated by a vertical distance greater than the vertical distance separating confronting surfaces 432 and 434 on the adapter nose portion 426. That is, the predetermined configuration of the tooth cavity 450 is larger in cross-section than the predetermined configuration defined by the adapter nose portion 426. As such, and as shown in FIG. 27, when the adapter nose portion 426 is operably assembled within the tooth cavity 450, a space or relief 459 is defined between surface 434 on the adapter nose portion 426 and the confronting surface 454 on tooth cavity 450.

In the embodiment shown in FIG. 27, a free ended lock 460 extends into the socket 450 and toward the tooth assembly axis 416. Lock 460 has a cross-sectional configuration which is equal to or smaller than the cross-section of the recess 439 defined by the adapter nose portion 426. Notably, the lateral distance separating the free end of lock 460 from the opposed surface 454 of tooth cavity 450 is such as to permit longitudinal translation of the adapter nose portion 426 relative to the tooth socket 450 and longitudinally past lock 460.

Lock 460 is preferably formed as a lug 462 formed integral with the tooth 420. As discussed above, however, other lock designs (see FIG. 4A) can be used and provided without detracting or departing from the true spirit and novel concept of this invention disclosure. As shown in FIG. 27, when the adapter nose portion 426 and tooth 450 are arranged in operable combination with each other, lock 460 is in registry with and extends into the recess 439 defined by the adapter nose portion 426. As such, tooth 420 is locked to the adapter nose portion 426 and the working loads and forces encountered by the tooth assembly during operation are advantageously transferred from the digging tooth 420 to the adapter 422 through the lock 460 extending into the recess 439 on the adapter nose portion 26.

In accordance with the present disclosure, and as illustrated by way of example in FIGS. 26 and 27, the tooth assembly is furthermore provided with a spacer or securement member 470. As with securement member 70 discussed above, the securement member 470 is insertable into the relief or space 459 defined between the confronting surfaces on the adapter nose portion 426 and tooth cavity 450 so as to at least partially fill the relief 459 and urge the tooth in a direction toward lock 460 thereby maintaining the lock 460 within the recess 439 in the adapter nose portion 426 so as to inhibit longitudinal translation of the tooth 420 relative to the adapter nose portion 426. Preferably, securement member 470 extends in a direction relative to the longitudinal axis 416 of the tooth assembly so as to advantageously avoid operating loads being applied directly thereto during operation of the digging tooth assembly.

As shown in FIG. 27, and after the tooth 420 is arranged in operable combination with adapter 422, a portion 474 of securement member 470 fits between the exterior of adapter nose portion 426 and the interior of the tooth socket 450 opposite from lock 460. By this design, member 470 advantageously avoids operating loads being applied directly thereto during operation of the digging tooth assembly. As such, wear on securement member 470 is minimized thus allowing securement member 470 to be reused, if desired, when a replacement part 420 is again attached to adapter 422.

The securement member or spacer 470 preferably has a design similar to lock 70 discussed in detail above and includes an enlarged head portion 472 (FIG. 26) and shank portion 474 (FIG. 27). The exposed section of the head portion 472 of member 470 generally follows the profile of tooth 420 to promote movement of material therepast.

The interior surface of tooth cavity 450 along with the securement member 470 preferably have a key and keyway design, generally identified in FIG. 27 by reference numeral 479. The key and keyway design 479 is similar to the key and keyway design discussed in detail above. Such design advantageously allows securement member 470 to interact with tooth 420 so as to guide insertion of the member 470 into operable combination with the tooth 420 while preferably limiting the direction securement member 470 can be correctly inserted into operable combination with the tooth 420 and adapter nose portion 426.

In the example shown in FIG. 26, side wall 448' of the wear part or tooth 420 defines an opening 480 arranged adjacent to surface 454 of and extending through to the blind cavity or socket 450 of the tooth 420. Notably, in the example illustrated in FIG. 26, the opening 480 defined by tooth 420 is arranged adjacent to that surface 454 of the blind cavity 450 opposite from lock 460. The opening 480 in the tooth 420 permits the shank portion 474 of member 470 (FIG. 27) to pass endwise therethrough while limiting movement of the enlarged head portion 472 from passing therethrough. As such, the marginal edge of the opening 480 acts as a limit stop for member 470.

An opening 481 (FIG. 25) in the side wall 448 of wear part 420 proximate to surface 454 of cavity 450 permits endwise passage of a suitably shaped tool (not shown) therethrough so as to engage and push against member 470 whereby facilitating removal of member 470, when required or desired, from the space or gap 459 between wear part 420 and the adapter nose portion 426 to effect repair/replacement of the wear part 420. Passage of the tool through opening 481 on tooth 420 will cause displacement of the member 470 through the tooth opening 480. Only after member 470 is removed from between the tooth 420 and adapter nose portion 426 can the wear part 420 be shifted whereby releasing the adapter nose portion 46 from operable engagement with the lock 60 (FIG. 27) on the tooth 420 and thereafter permitting the longitudinal translation of the tooth 420 relative the adapter nose portion 426 to effect release of the tooth 420 from adapter 422.

When securement member 470 is fully inserted into operable combination with the tooth 420 and adapter 422, a portion of the head portion 472 of member 470 overlies and is arranged in confronting relation relative to a portion of tooth 420. As shown in FIG. 26, a slot or other suitably shaped recess 481*a* extends to the exterior of tooth 420 from a marginal edge of the opening 480. Besides those steps mentioned above for effecting release of member 470 from engagement with the tooth 420 and adapter 422, opening 481*a* furthermore allows a suitably shaped tool (not shown) to be inserted between the head portion 472 of member 470 and that portion of the tooth 420 arranged in confronting relation relative thereto to effect separation between member 470 and tooth 420 whereby effecting release of the member 470.

As shown in FIG. 27, a secondary lock 490 is preferably provided for releasably maintaining member 470 in position between tooth 420 and the adapter nose portion 426 during operation of the tooth assembly whereby inhibiting inadvertent longitudinal separation of the tooth 420 relative to the adapter 422. More specifically, and in the example shown in FIG. 27, the secondary lock 490 is arranged in operable combination with the digging tooth 420, the adapter nose portion 426, and member 470.

In the embodiment shown in FIG. 27, the secondary lock 490 is designed as a detent mechanism 492 arranged within the recess 439 defined by the adapter nose portion 426 for releasably maintaining member 470 between the tooth 420 and the adapter nose portion 426 during operation of the digging tooth assembly 410. In the embodiment illustrated in FIG. 27, mechanism 492 is substantially similar to and functions in the substantially the same manner as mechanism 92 discussed in detail above. It will be appreciated, however, and as discussed above, the secondary lock 490 can take varied configurations without detracting or departing from the spirit and scope of the present disclosure.

Figure 28:
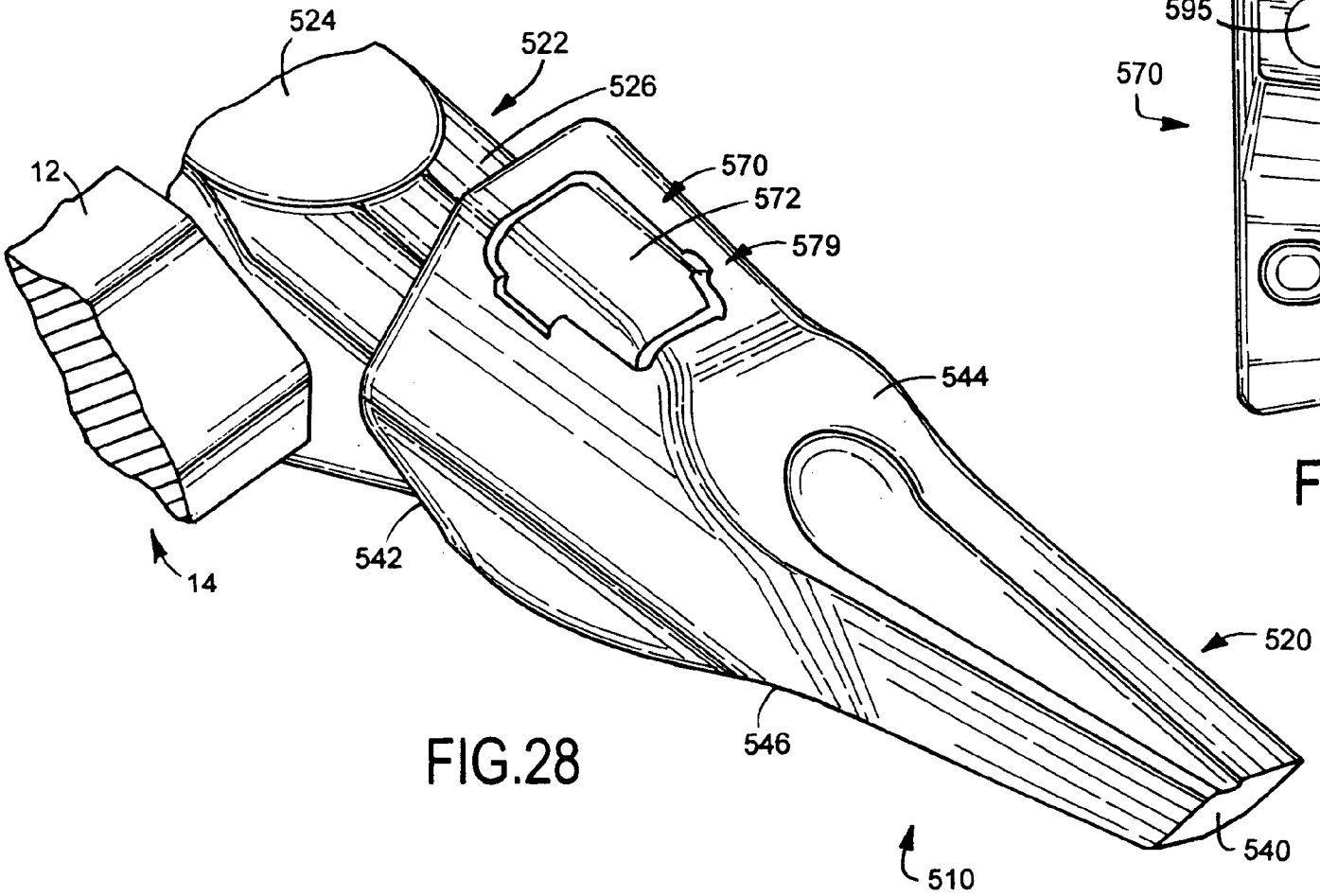
FIG. 28 is a perspective view of another form of tooth assembly.
Figure 29:
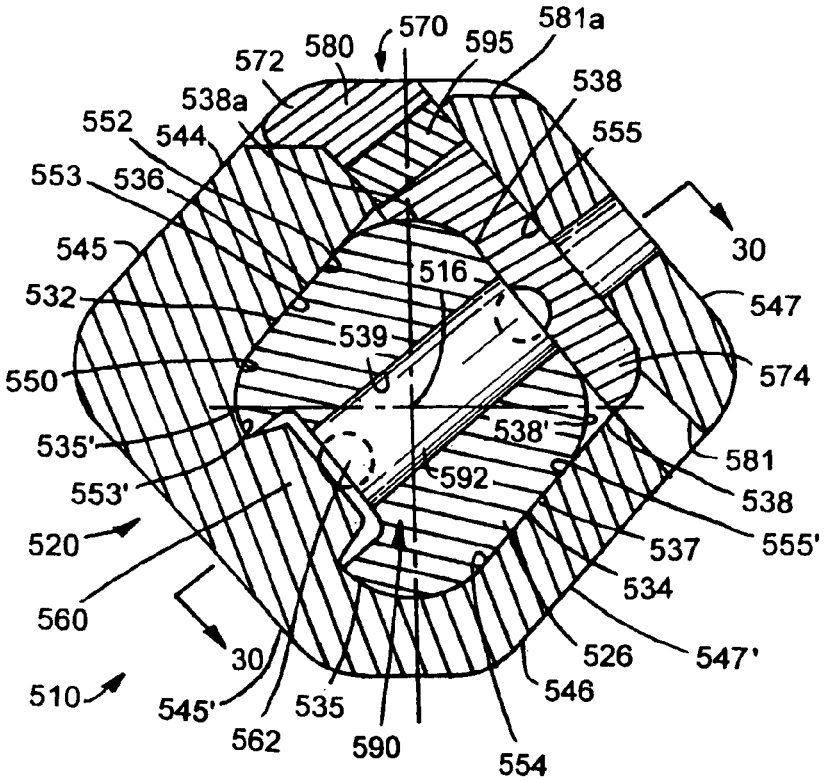
FIG. 29 is a transverse sectional view of the tooth assembly shown in FIG. 28.
Figure 30:
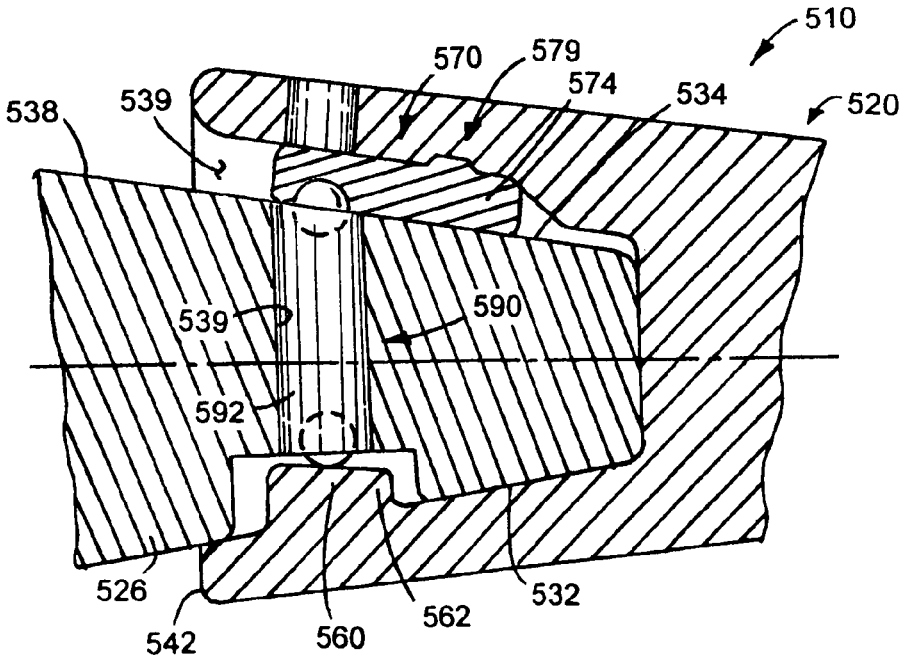
FIG. 30 is a sectional view taken along line 30-30 of FIG. 29.

FIGS. 28 through 30 illustrate yet another two-part tooth assembly including another form of tooth and adapter. The tooth or wear part illustrated in FIGS. 28 through 30 is designated generally by reference numeral 520. In the illustrated embodiment, the replaceable wear part 520 is designed as a digging tooth. As mentioned, however, the wear part can take any of a myriad of different designs other than a tooth, i.e., a ripper, lip shroud, wear cap, etc. without detracting or departing from the true spirit and scope of this invention disclosure. The adapter or support illustrated in FIGS. 28 through 30 is designated generally by reference numeral 522. The elements of this alternative digging tooth assembly which are functionally analogous to those components or elements discussed above regarding digging tooth 20 and adapter 22 are designated by reference numerals identical to those listed above with the exception this embodiment uses reference numerals in the 500 series.

Turning to FIG. 28, the adapter 522 has an elongated and preferably unitary construction and includes a base portion 524 and an elongated nose portion 526 projecting forward from the base portion 524. The adapter base portion 524 is configured for suitable attachment to the edge or lip 12 of the bucket or implement 14 through any suitable and well known means including fasteners, welding, etc.

The configuration of the adapter nose portion 526, illustrated by way of example in FIGS. 28 through 30, is such that a longitudinal cross-sectional configuration of the adapter nose portion 526 increases as measured rearwardly from a free end of the adapter nose portion 526. In the example selected for illustrative purposes in FIGS. 28 through 30, the adapter nose portion 526 is configured in accordance with the teachings and principals set forth in U.S. Pat. Nos. 6,047,487 and 6,247,255 assigned to H&L Tooth Company; the applicable portions of which are incorporated herein by reference.

As shown in FIG. 29, the adapter nose portion has top and bottom angled surfaces 532 and 534 which converge relative to each other and toward the free end 535 (FIG. 30) of the adapter 522. In the embodiment shown in FIG. 29, the top surface 532 of adapter nose portion 526 has two downwardly angled sides 536 and 538 disposed to opposed lateral sides of the longitudinal axis 516 of the tooth assembly 510. Similarly, the bottom surface 534 of adapter nose portion 526 has two upwardly angled sides 535 and 537 disposed to opposed lateral sides of the longitudinal axis 516 of the tooth assembly 510. In the embodiment illustrated in FIG. 29, the angled sides 535 and 536 are joined to each other along an edge 535'.

Similarly, in the embodiment illustrated in FIG. 29, the angled sides 537 and 538 are joined to each other along an edge 538'. Suffice it to say, the adapter nose portion 526 has a first predetermined configuration.

As shown in FIGS. 29 and 30, the adapter or support 522 defines a recess or bore 539 disposed toward a rear of the nose portion 526 and extends generally normal to the tooth assembly axis 516. In the form shown in FIG. 29, recess 539 is defined by an angled throughbore which opens to the angled side 538 of the top surface 532 of the adapter nose portion 526 to one side of the longitudinal axis 516 of tooth assembly 510 and to the angled side 535 of the bottom surface 534 of the adapter nose portion 526 on an opposed side of the longitudinal axis 516 of tooth assembly 510 while passing generally through the longitudinal axis 516 of the tooth assembly 510. Of course, recess 539 can alternatively be defined by an angled throughbore which opens to the angled side 536 of the top surface 532 of the adapter nose portion 526 to one side of the longitudinal axis 516 of tooth assembly 510 and to the angled side 537 of the bottom surface 534 of the adapter nose portion 526 on an opposed side of the longitudinal axis 516 of tooth assembly 510 while passing generally through the longitudinal axis 516 without detracting or departing from the true spirit and scope of this invention disclosure. In the illustrated embodiment, recess 539 has a closed marginal edge.

In the example shown in FIG. 26, the wear part or tooth 520 has an longitudinally elongated wedge shape between a forward cutting edge or end 540, operative to engage the material to be worked, and a rear end 542 thereof. Like adapter 522, tooth 520 is preferably formed from a ferrous metal, i.e., steel or a steel alloy. Preferably, tooth 520 has a unitary design including an upper slanted surface 544 and a lower slanted surface 546 arranged in converging relation toward the end 540 of the tooth 520. In the embodiment illustrated in FIG. 29, the upper or top surface 544 of tooth 520 includes two downwardly angled sides 545 and 547 disposed to opposed lateral sides of the longitudinal axis 516 of the tooth assembly 510. Similarly, the bottom surface 546 of tooth 520 has two upwardly angled sides 545' and 547' disposed to opposed lateral sides of the longitudinal axis 516 of the tooth assembly 510. Of course, the exterior surfaces of tooth 520 can take a myriad of different shapes from that shown without detracting or departing from the true spirit and scope of this disclosure.

As shown in FIGS. 29 and 30, the wear part or tooth 520 defines an open-ended blind cavity or socket 550 for longitudinally receiving and accommodating at least a lengthwise section of the adapter nose portion 526. Suffice it to say, socket 550 has a predetermined configuration which compliments or proximates the configuration of the adapter nose portion 526. In the illustrated form, the socket 550 has a larger cross-sectional configuration toward an open end than toward a closed end thereof. In the illustrated embodiment, the tooth cavity or socket 450 has top and bottom angled surfaces 552 and 554 (FIG. 29), respectively, which converge relative to each other and toward a forward end of the tooth cavity 450.

In the illustrated embodiment, and as described in further detail in the afore-mentioned U.S. patents to H&L Tooth Company, the top surface 552 of the tooth cavity 550 is defined, at least in part, by two angled sides 553 and 555 disposed to opposed sides of the longitudinal axis 516. Similarly, and in the illustrated embodiment, the bottom surface 554 of the tooth cavity 550 is defined, at least in part, by two angled sides 553' and 555' disposed to opposed sides of the longitudinal axis 516. Suffice it to say, the tooth cavity 550 has a second predetermined configuration which is proximate to but different from the first cross-sectional configuration defined by the adapter nose portion 526.

As shown in FIGS. 29 and 30, the angled side 538 of the adapter nose portion top surface 532 and the angled side 555 of the top surface 552 of tooth cavity 550 are spaced or otherwise separated by a distance greater than the distance than the angled side 536 of the adapter nose portion top surface 532 and the angled side 555' of the bottom surface 554 of tooth cavity 550. Because the predetermined configuration of the tooth cavity 550 is larger in cross-section than the predetermined configuration defined by the adapter nose portion 526, and as shown in FIGS. 29 and 30, when the adapter nose portion 526 is operably assembled within the tooth cavity 550, a space or relief 559 is defined between the angled side 538 on the adapter nose portion 526 and the confronting surface 555 on tooth cavity 550.

In the embodiment shown in FIGS. 29 and 30, a free ended lock 560 extends into the socket 550 and toward the tooth assembly axis 516. Lock 560 has a cross-sectional configuration which is equal to or smaller than the cross-section of the recess 539 defined by the adapter nose portion 526. Notably, the distance separating the free end of lock 560 from the opposed surface 555 of tooth cavity 550 is such as to permit longitudinal translation of the adapter nose portion 526 relative to the tooth socket 550 and longitudinally past lock 560.

Lock 560 is preferably formed as a lug 562 formed integral with tooth 520. As discussed above, however, other lock designs (see FIG. 4A) can be used and provided without detracting or departing from the true spirit and novel concept of this invention disclosure. As shown in FIGS. 29 and 30, when the adapter nose portion 526 and tooth 550 are arranged in operable combination with each other, lock 560 is in registry with and extends into the recess 539 defined by the adapter nose portion 526. As such, the working loads and forces encountered by the tooth assembly during operation are advantageously transferred from the digging tooth 520 to the adapter 522 through the lock 560 extending into the recess 539 on the adapter nose portion 526.

As illustrated by way of example in FIGS. 29 and 30, the tooth assembly is furthermore provided with a spacer or securement member 570. As with securement member 70 discussed above, and as shown in FIG. 30, the securement member 570 is insertable into the relief or space 559 defined between the confronting surfaces on the adapter nose portion 526 and tooth cavity 550 so as to at least partially fill the relief 559 and urge the tooth in a direction toward lock 560 thereby maintaining the lock 560 within the recess 539 in the adapter nose portion 526 so as to inhibit longitudinal translation of the tooth 520 relative to the adapter nose portion 526. Preferably, securement member 570 extends in a direction relative to the longitudinal axis 516 of the tooth assembly so as to advantageously avoid operating loads being applied directly thereto during operation of the digging tooth assembly.

As shown in FIG. 29, and after the tooth 520 is arranged in operable combination with adapter 522, a portion 574 of securement member 570 fits between the exterior of adapter nose portion 526 and the interior of the tooth socket 550 opposite from lock 560. By this design, member 570 advantageously avoids operating loads being applied directly thereto during operation of the digging tooth assembly. As such, wear on securement member 570 is minimized thus allowing securement member 570 to be reused, if desired, when a replacement part 520 is again attached to adapter 522.

The securement member or spacer 570 preferably has a design similar to lock 70 discussed in detail above and includes an enlarged head portion 572 (FIGS. 28 and 29) and shank portion 574 (FIGS. 29 and 30). Preferably, the exposed section of the member head portion 572 generally follows the profile of tooth 520 to promote movement of material therepast.

The interior surface of tooth cavity 550 along with the securement member 570 preferably have a key and keyway design, generally identified in FIGS. 28 and 30 by reference numeral 579. The key and keyway design 579 is similar to the key and keyway design discussed in detail above except in this embodiment the key and keyway design preferably has a generally linear design as compared to the curved or arcuate key and keyway design discussed above. This design change notwithstanding, the key and keyway 579 preferably provided in combination with the securement member 570 and the tooth cavity 550 advantageously allows securement member 570 to interact with tooth 520 so as to guide insertion of the member 570 into operable combination with the tooth 520 while preferably limiting the direction securement member 570 is inserted into operable combination with the tooth 520 and adapter nose portion 526.

In the example shown in FIG. 29, the top surface 544 of the wear part or tooth 520 defines an opening 580 arranged adjacent to the angled side 555 of and extending through to the blind cavity or socket 550 of the tooth 520. Notably, in the example illustrated in FIG. 29, the opening 580 defined by tooth 520 is arranged adjacent to that angled side 555 of the blind cavity 550 opposite from lock 560. The opening 580 in the tooth 520 permits the shank portion 574 of member 570 (FIG. 29) to pass endwise therethrough while limiting movement of the enlarged head portion 572 if member 570 from passing completely into the recess 539.

Figure 31:
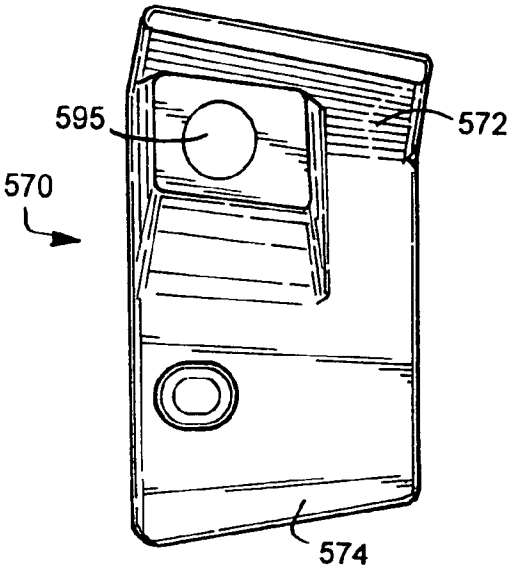
FIG. 31 is an elevational view of another form of securement member.

In the embodiment of the securement member illustrated in FIGS. 29 and 31, a lower section of the securement member 570 is configured to engage with the adapter nose portion 526. That is, in the embodiment illustrated by way fo example in FIG. 29, the angled sides 536 and 538 on the upper surface 532 of the adapter nose portion are joined to each other along a longitudinally extending edge 538*a*. In the embodiment illustrated by way of example in FIG. 29, the longitudinally extending edge 538*a* has a curved or arcuate configuration in cross-section. Moreover, the lower section of the securement member 570 is configured to engage with the longitudinally extending edge 538*a* on the adapter nose portion whereby adding stability and strength to the releasable conjunction between the tooth 520 and adapter nose portion 526.

As shown in FIG. 29, an opening 581 in the bottom surface 546 of wear part 520 proximate to the angled side 555 of cavity 550 permits endwise passage of a suitably shaped tool (not shown) therethrough so as to engage and push against member 570 whereby facilitating removal of member 570, when required or desired, from the space or gap 559 between wear part 520 and the adapter nose portion 526 to effect repair/replacement of the wear part 520. Passage of the tool through opening 581 on tooth 520 will cause displacement of the member 570 through the tooth opening 580. Only after member 570 is removed from between the tooth 520 and adapter nose portion 526 can the wear part 520 be shifted to release the adapter nose portion 526 from operable engagement with the lock 560 (FIGS. 29 and 30) on the tooth 520 and thereafter permit the longitudinal translation of the tooth 520 relative the adapter nose portion 526 to effect release of the tooth 520 from adapter 522.

When securement member 570 is fully inserted into operable combination with the tooth 520 and adapter 522, a portion of the head portion 572 of member 570 overlies and is arranged in confronting relation relative to a portion of tooth 520. As shown in FIG. 29, a slot or other suitably shaped recess 581*a* extends to the exterior of tooth 520 from a marginal edge of the opening 580. Besides those steps mentioned above for effecting release of member 570 from engagement with the tooth 520 and adapter 522, opening 581*a* furthermore allows a suitably shaped tool (not shown) to be inserted between the head portion 572 of member 570 and that portion of the tooth 520 arranged in confronting relation relative thereto to effect separation between member 570 and tooth 520 whereby effecting release of the member 570.

As shown in FIGS. 29 and 30, a secondary lock 590 is preferably provided for releasably maintaining member 570 in position between tooth 520 and the adapter nose portion 526 during operation of the tooth assembly whereby inhibiting inadvertent longitudinal separation of the tooth 520 relative to the adapter 522. More specifically, and in the example shown in FIGS. 29 and 30, the secondary lock 590 is arranged in operable combination with the digging tooth 520, the adapter nose portion 526, and member 570.

In the embodiment shown in FIGS. 29 and 30, the secondary lock 590 is designed as a detent mechanism 592 arranged within the recess 539 defined by the adapter nose portion 526 for releasably maintaining member 570 between the tooth 520 and the adapter nose portion 526 during operation of the digging tooth assembly 510. In the embodiment illustrated in FIGS. 29 and 30, mechanism 592 is substantially similar to and functions in the substantially the same manner as mechanism 92 discussed in detail above.

It will be appreciated, however, and as discussed above, the secondary lock 590 can take varied configurations without detracting or departing from the spirit and scope of the present disclosure. For example, the secondary lock for releasably maintaining the locking member 590 operably between the tooth 520 and adapter nose portion 526 can involve forming the locking member 570 from a magnetic material. Alternatively, and as shown in FIGS. 29 and 30, a magnetic insert 595 can be carried by and formed as part of the securement member 570. Although substantially any magnetic material would suffice, such magnetic insert 595 is preferably formed from a magnetic material including neodymium and of the type sold by K&J Magnetics, Inc. in Jamison, Pa. 18929.

As shown in FIG. 29, when securement member 570 is fully inserted between the tooth 520 and adapter nose portion 526, the magnetic insert 595 is arranged in confronting and attractive relation with a portion of either the digging tooth 520 and/or adapter nose portion 526. As such, the magnetic attraction between the insert 595 in securement member 570 and the tooth 520 and/or adapter nose portion 526 inhibits inadvertent displacement of the securement member 570 from operably between the tooth 520 and adapter nose portion 560 whereby maintaining the digging tooth 520 locked to the adapter nose portion through lock 560.

Figure 33:
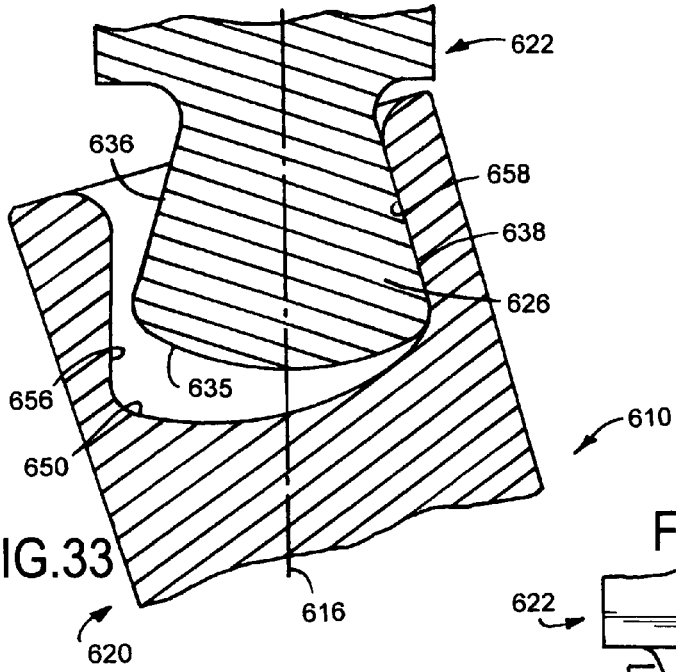
FIGS. 32 through 34 are views of an alternative form of tooth assembly embodying principals and teachings of the present disclosure.
Figure 32:
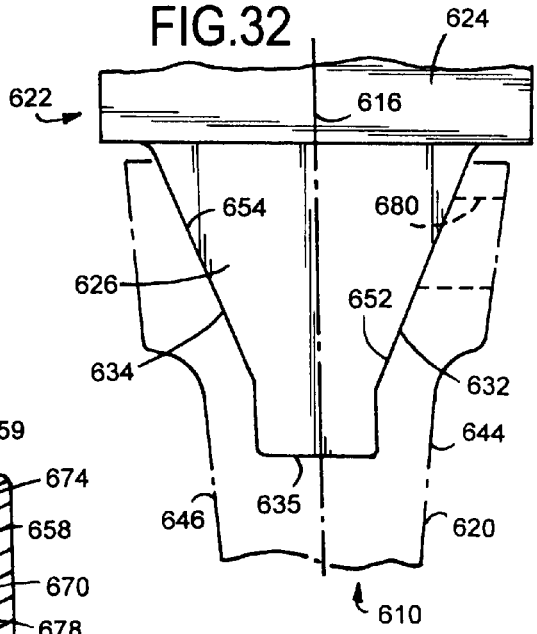
Figure 34:
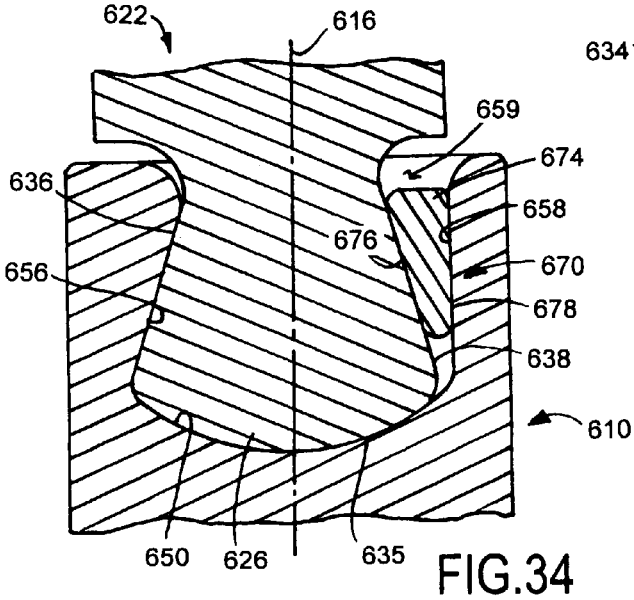

Still another alternative tooth assembly design is illustrated by way of example in FIGS. 32 through 34. This alternative tooth assembly design is designated generally by reference numeral 610. The elements of this alternative tooth assembly design that are functionally analogous to those components discussed above regarding the tooth assembly 10 are designated by reference numerals identical to those listed above with the exception this embodiment uses reference numerals in the 600 series.

Tooth assembly 610 has a longitudinal axis 616 and includes a replaceable wear part 620 and an adapter or support 622. In the illustrated embodiment, the replaceable wear part 620 is designed as a tooth. As mentioned, however, the wear part of assembly 610 can take a myriad of different designs other than a tooth, i.e., a ripper, lip shroud, wear cap, etc. without detracting or departing from the spirit and scope of this invention disclosure.

In the exemplary embodiment illustrated in FIG. 32, the adapter 622 has an elongated and preferably unitary construction and includes a conventional base portion 624 and a longitudinally elongated nose portion 626 projecting forward from the base portion 624. The adapter base portion 624 is configured for suitable attachment to the edge or lip a bucket or implement (not shown) through any suitable and well known means including fasteners, welding, etc. The adapter nose portion 626 has a predetermined configuration. In the embodiment shown for exemplary purposes, the adapter nose portion 626 has top and bottom angled surfaces 632 and 634, respectively, which converge relative to each other toward a free end 635 of the adapter 622.

In the form shown in FIG. 33, the adapter nose portion 626 furthermore includes a pair of laterally spaced sides 636 and 638. In the embodiment illustrated in FIGS. 33 and 34, the sides 636 and 638 are angled opposite relative to each other and are angled relative to the longitudinal tooth assembly axis 616 such that they converge toward a rear end of the adapter nose portion 626. As such, the free or forward end 635 of the adapter nose portion 626 has a lateral width greater than the lateral width across the rear end of the adapter nose portion 626.

The free forward end 635 of the adapter nose portion 626 preferably has a generally constant circular shape in plan so as to distribute the working loads applied thereto across a wider horizontal bearing surface. This design also increases stabilization of the tooth-to-adapter connection by reducing horizontal movements in digging applications.

In the illustrated embodiment, each side 636, 638 of the adapter nose portion 626 has a back draft angle of no less than about 7° and no greater than about 22° relative to the longitudinal axis 616 of the tooth assembly 610. A back draft angle of less than 7° creates a possible locking angle between the tooth 620 and adapter nose portion 626 which could cause tooth removal problems after the tooth assembly 610 has been used for long periods of field work and applied operating loads. A back draft angle in excess of 22° would yield greater interference, or holding power between the tooth 620 and the adapter nose portion 626 but is likely to cause nose pinching or reduced cross section toward the rear of the adapter nose portion 626 generating an overall weaker adapter 622.

As shown by way of example in FIG. 32, the replaceable wear part or tooth 620 of assembly 610 has an longitudinally elongated wedge shape between a forward end and a rear end thereof. Preferably, the digging tooth 620 has a unitary design including an upper slanted wall 644 and a lower slanted wall 646 arranged in converging relation toward the forward end of the tooth 620. As mentioned above, the outer configuration of the tooth 620 can take a myriad of designs without detracting or departing from the spirit and scope of this disclosure.

As shown in FIG. 33, tooth 620 defines an open ended blind cavity or socket 650 for longitudinally receiving and accommodating at least a lengthwise section of the adapter nose portion 626 by relative longitudinal movement or translation. The blind cavity 650 defined by tooth 620 has a predetermined configuration which is larger than the adapter nose portion predetermined configuration. In the embodiment illustrated in FIG. 32, the tooth cavity 650 has top and bottom angled surfaces 652 and 654, respectively, which compliment the top and bottom angled surfaces 632 and 634, respectively, on the adapter nose portion 626 and which converge relative to each other. As shown in FIG. 33, the blind cavity or socket 650 defined by tooth 620 furthermore includes a pair of laterally spaced side surfaces 656 and 658.

In the embodiment illustrated in FIG. 34, side surface 658 of the blind cavity 650 extends generally parallel to the longitudinal axis 616 of the tooth assembly 610 when tooth 620 is operably connected to the adapter nose portion 626. When tooth 620 is operably connected to the adapter nose portion 626, the other side surface 656 of the tooth cavity 650 is angled relative to the tooth assembly axis 616 such that surface 656 converges toward a rear end of the cavity 650 and toward the longitudinal tooth assembly axis 616. As such, the closed end of the tooth cavity 650 has a lateral width greater than the lateral width across the open end of the cavity 650. Preferably, the back draft angle of the side surface 656 of cavity 650 is complimentary to the back draft angle associated with the side 636 of the adapter nose portion 626.

As shown in FIG. 33, the adapter nose portion 626 and the blind tooth cavity 650 are configured relative to each other such that a rear of the tooth 620 must be laterally shifted sideways relative to the longitudinal tooth assembly axis 616 to allow the adapter nose portion 626 to be longitudinally inserted into the blind tooth cavity 650. After the adapter nose portion 626 has been longitudinally fitted within the tooth cavity 650, the rear end of the tooth 620 is angled again laterally toward the longitudinal tooth assembly axis 616 to arrange tooth 610 and adapter 622 in axially aligned working relation relative to each other. Because of this tooth angling installation requirement, the reverse becomes necessary to remove the tooth 620 from operable combination with the adapter nose portion 626.

As is evident from FIG. 34, the adapter nose portion 626 and the blind tooth cavity 650 are configured and sized relative to each other such that an opening or space 659 exists between side 638 of the adapter nose portion 626 and the confronting surface 658 of the blind tooth cavity 650 when the side 636 of the adapter nose portion 626 and the confronting surface 656 of the blind tooth cavity 650 are arranged in contacting and working relation relative to each other.

At least partially filling the space 659 while shifting the tooth 620 relative to the adapter nose portion 626, tooth assembly 610 is provided with a securement member 670 for maintaining the tooth 620 and adapter 622 in operable combination relative to each other. In one form, th4 securement member 670 extends generally vertical to the longitudinal axis 616 of the tooth assembly 610. To effect such ends, and in a manner similar to that discussed above regarding tooth assembly 10, member 670 is insertable into the space 659 between the wear part 620 and the adapter nose portion 626 through an opening 680 in the slanted top wall 644 (FIG. 32) of the tooth 620 and, thus, avoids operating loads being applied directly thereto. During operation of the tooth assembly 610, member 670 prevents the tooth 620 from angling and dislodging from the adapter nose portion 626 thereby inhibiting the tooth 620 from longitudinal translation or movement relative to the adapter nose portion 626 required in removing the tooth 620 from the adapter nose portion 626.

With the exceptions noted below, securement member 670 is configured substantially similar to that discussed above regarding securement member 70. In the form shown in FIG. 34, member 670 includes a shank portion 674 having two laterally spaced sides 676 and 678 with an arcuate configuration between the free end thereof and that end joined to a head portion of member 670 similar to head portion 72 of member 70. In the embodiment shown by way of example in FIG. 34, and after the adapter nose portion 626 is longitudinally arranged in combination with the tooth 620, the shank portion 674 of member 670 extends across substantially an entire side of the adapter nose portion 626 when member 670 is fully inserted into an operational position.

In the embodiment shown in FIG. 34, the sides 676 and 678 of the shank portion 674 of securement member 670 angularly diverge relative to each other in a manner complimentary to the angled side 638 on the adapter nose portion 626 and side surface 658 of the tooth cavity 650. As such, and when the shank portion 674 of member 670 is inserted into the space 659 between the adapter nose portion 626 and the tooth 620, a wedging force is applied to the tooth 620 and adapter nose portion 626 during longitudinal translation of the tooth 620 relative to the adapter 622. The wedging action exerted by the securement member 670 will advantageously and longitudinally urge the tooth 620 onto the adapter 622.

Suffice it to say, a secondary lock similar to any of those described in detail above can be arranged in operable combination with lock 670. As above, the purpose of such a secondary lock is to inhibit inadvertent displacement of the securement member 670 from the space relief 659 separating the wear part from the adapter nose portion.

There is also provided a method for releasably coupling a wear part or tooth to an adapter, wherein the tooth has an upper wall and a lower wall converging toward a free end of the tooth and a rearwardly opening socket formed therein. The tooth socket has a first predetermined configuration. In one form, the tooth socket is defined by an upper surface, a lower surface, and a pair of laterally spaced side surfaces extending between the upper and lower surfaces. The upper wall of the tooth defines an opening arranged adjacent to one of the side surfaces of and extending through to the socket. The adapter has a nose portion adapted to be longitudinally received and accommodated within the socket defined by the tooth. The adapter nose portion has a second predetermined configuration which is smaller than the first predetermined configuration of the tooth socket. In one form, the adapter nose portion has a pair of laterally spaced sides along with top and bottom surfaces. The predetermined configurations defined by the adapter nose portion and the tooth socket are such that a space is provided between the adapter nose portion and the tooth socket after the tooth and adapter are arranged in operable combination relative to each other. The method comprises the step of: inserting a securement member or lock for coupling the tooth and adapter in operable combination relative to each other through an opening in the tooth such that a portion of the securement member or lock bears against one side surface of the socket and a confronting side of the nose portion of the adapter whereby shifting the tooth to thereby inhibit longitudinal translation of the tooth relative to the adapter as long as the securement member or lock is retained between the tooth and the nose portion of the adapter.

The method for releasably coupling the tooth and adapter in operable combination relative to each other can further include the further step of: angling the tooth in a first sideways direction sufficiently to permit longitudinal translation of a free end of the adapter into the socket defined by the tooth. The method for releasably coupling the tooth and adapter in operable combination relative to each other can further include the further step of: angling the tooth in a second sideways direction sufficiently to align said tooth and adapter along a longitudinal axis defined by the tooth assembly. Also, the method for releasably coupling the tooth and adapter in operable combination relative to each other can include the further step of: using a secondary lock for releasably securing the tooth and adapter in operable combination relative to each other.

With the present invention disclosure, variances between the size and configuration of the tooth socket and the adapter nose portion are readily tolerated and accepted. The simple design proposed by the present disclosure advantageously yields possibilities which have heretofore been unknown by those skilled in the art. That is, by inserting a securement member or lock having different shank portion designs between the tooth and adapter nose portion in a direction extending generally perpendicular to the longitudinal axis of the tooth assembly, teeth manufactured, sold and distributed by different manufacturers can be used in combination with either new adapters manufactured, sold and distributed by other manufacturers or that existing population of adapters already existing in the field. Accordingly, an operator is not necessarily required to always return to the original equipment manufacturer for replacement parts only because no one else can provide parts for the particular model tooth/adapter combination being used by that operator. Instead, and with the present invention disclosure, the operator merely selects a securement member or lock which will accommodate the size variances between the tooth socket and adapter nose portion of the particular parts whereby opening a realm of possibilities which have been heretofore unknown.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A tooth assembly having a longitudinal axis, said tooth assembly comprising:

a tooth having upper and lower slanted walls and a rearwardly opening socket formed therein, with said socket having a first cross-sectional configuration defined by said tooth which is larger toward an open end of said socket than toward the closed end of said socket, with the first cross-sectional configuration of said socket being at least partially defined by a pair of opposed sides laterally separated by a predetermined distance, and with at least one side of said tooth socket having a generally planar configuration;

an adapter having a nose portion configured to be longitudinally received and accommodated within the socket defined by said tooth, with said adapter nose portion having a second cross-sectional configuration which proximate the first cross-sectional configuration of the socket defined by said tooth, with the second cross-sectional configuration of said adapter nose portion being at least partially defined by two laterally spaced side walls, and with the lateral spacing between the side walls of the nose portion of said adapter being less than the predetermined distance separating the opposed sides of the socket defined by said tooth such that, when the adapter nose portion is arranged in operable combination with said tooth, a relief is defined between confronting surfaces on the tooth socket and the adapter nose portion, and wherein said adapter nose portion further defines a recess for laterally accommodating a free ended lock on said tooth and projecting toward the longitudinal axis of said tooth assembly whereby releasably coupling said tooth and adapter in operable combination relative to each other, and wherein said lock is a lug that is formed integral with said tooth; and a securement member insertable into the relief defined between the confronting surfaces on the tooth socket and the adapter nose portion so as to fill said relief and urge the tooth in a lateral direction relative to the adapter nose portion thereby forcibly maintaining the lock carried by said tooth securely within the recess in the adapter whereby inhibiting longitudinal translation of said tooth relative to the adapter nose portion as long as said lock is retained within the recess defined by the nose portion of the adapter.

2. A tooth assembly having a longitudinal axis, said tooth assembly comprising:

a tooth having upper and lower slanted walls and a rearwardly opening socket formed therein, with said socket having a first cross-sectional configuration defined by said tooth which is larger toward an open end of said socket than toward the closed end of said socket, with the first cross-sectional configuration of said socket being at least partially defined by a pair of opposed sides laterally separated by a predetermined distance, and with at least one side of said tooth socket having a generally planar configuration;

an adapter having a nose portion configured to be longitudinally received and accommodated within the socket defined by said tooth, with said adapter nose portion having a second cross-sectional configuration which proximate the first cross-sectional configuration of the socket defined by said tooth, with the second cross-sectional configuration of said'adapter nose portion being at least partially defined by two laterally spaced side walls, and with the lateral spacing between the side walls of the nose portion of said adapter being less than the predetermined distance separating the opposed sides of the socket defined by said tooth such that, when the adapter nose portion is arranged in operable combination with said tooth, a relief is defined between laterally confronting surfaces on the tooth socket and the adapter nose portion and longitudinally opens to a rear end of the tooth, and wherein said adapter nose portion further defines a recess for laterally accommodating a free ended lock carried by said tooth and projecting toward the longitudinal axis of said tooth assembly whereby releasably coupling said tooth and adapter in operable combination relative to each other; and a securement member slidably insertable into the relief defined between the confronting surfaces on the tooth socket and the adapter nose portion through an opening defined in the upper slanted wall of said tooth so as to at least partially fill said relief, bear against the confronting surfaces on the tooth socket and the adapter nose portion, and slidably urge the tooth in a lateral direction relative to the adapter nose portion thereby forcibly maintaining the lock carried by said tooth securely within the recess in the adapter whereby inhibiting longitudinal translation of said tooth relative to the adapter nose portion as long as said lock is retained within the recess defined by the nose portion of the adapter.

3. The tooth assembly according to claim 1, wherein said lock is formed independent of said tooth.

4. The tooth assembly according to claim 1, wherein one wall of said tooth defines a bore for accommodating endwise passage of a tool used to facilitate removal of said securement member from between said tooth and adapter.

5. The tooth assembly according to claim 1, wherein a portion of said securement member has opposed and generally parallel sides.

6. The tooth assembly according to claim 5, wherein at least one of the sides of said securement member and a confronting surface defining the socket in said tooth has a key projecting therefrom, and wherein at least one of the sides of said securement member and a confronting surface defining the socket in said tooth defines a keyway for slidably accommodating said key when said securement member is inserted into operable combination with said tooth and adapter.

7. The tooth assembly according to claim 1, further including a secondary lock for releasably maintaining said securement member in position between said tooth and the nose portion of the adapter so as to inhibit inadvertent lateral shifting movement of said tooth relative to said adapter nose portion thereby maintaining the lock securely within the recess in the adapter nose portion.

8. The tooth assembly according to claim 7, wherein said secondary lock includes a resilient member disposed between a free end of said lock and the side of said securement member, and wherein said secondary lock further includes a detent carried by one of said resilient member and said securement member, with the other of said resilient member and said securement member defining a depression thereon such that, when the securement member is inserted fully between said tooth and the nose portion of the adapter, said detent snaps into said depression thereby releasably maintaining said securement member in position between said tooth and the nose portion of the adapter.

9. The tooth assembly according to claim 7, wherein said securement member includes magnetic material for releasably maintaining said securement member in position between said tooth and the adapter nose portion.

10. The tooth assembly according to claim 7, wherein said secondary lock includes an insert carried by said tooth, with a portion of said insert being arranged in operable combination with and serves to maintain said securement member in position between said tooth and the nose portion of the adapter.

11. The tooth assembly according to claim 10, wherein the insert of said secondary lock includes magnetic material.

12. A tooth assembly having a longitudinal axis, said tooth assembly comprising:

an adapter with a nose portion having top and bottom angled surfaces converging toward a free end of the nose portion of said adapter and a pair of sides which are laterally separated by a first predetermined distance, and with said adapter nose portion further defining a recess opening to both sides of the nose portion of said adapter;

a tooth assembled onto the nose portion of said adapter by relative longitudinal movement, said tooth having an upper wall and a lower wall converging toward a forward end of the tooth and a blind cavity opening to a rear of said tooth, with said blind cavity having top and bottom angled surfaces which proximate the respective top and bottom angled surfaces on the nose portion of said adapter and a pair of side surfaces, extending between said top and bottom angled surfaces of the blind cavity, and which are laterally separated by a second predetermined distance, with said second predetermined distance being greater than said first predetermined distance, and wherein one side surface of said blind cavity has a generally planar configuration;

a free ended lock on the tooth extends toward the longitudinal axis of said tooth assembly and aligns with the recess in the adapter nose portion when said adapter and tooth are longitudinally assembled in operable combination relative to each other; and a securement member insertable between and in bearing contact with a side of the adapter and an adjacent side surface defining the cavity in the tooth such that said securement member positively and releasably maintains the lock on the tooth within the recess in the adapter so as to prevent longitudinal movement of the tooth and adapter relative each other.

13. The tooth assembly according to claim 12, wherein an opening is provided in the upper wall of the tooth, which opening extends into said cavity and is arranged adjacent to the side surface of the blind cavity opposite from said lock for allowing at least a portion of said securement member to pass downwardly therethrough and into operable combination between and in bearing contact with a side of the adapter and an adjacent side surface defining the cavity in the tooth whereby maintaining the lock on the tooth within the recess in the adapter so as to prevent longitudinal movement of the tooth and adapter relative each other.

14. The tooth assembly according to claim 12, wherein the lock on said tooth is a lug that is formed integral with said tooth.

15. The tooth assembly according to claim 12, wherein the lock on said tooth is an insert formed independent of and carried by said tooth.

16. The tooth assembly according to claim 12, wherein the lower wall of said tooth defines a bore for accommodating endwise passage of a tool used to facilitate removal of said securement member from operable engagement between said tooth and adapter.

17. The tooth assembly according to claim 12, wherein a portion of said securement member has a pair of parallel sides.

18. The tooth assembly according to claim 17, wherein at least one of the sides of said securement member and a confronting surface defining a portion of the socket in said tooth has a key projecting therefrom, and wherein at least one of the sides of the securement member defines a keyway for slidably accommodating and guiding said key when the securement member is inserted between said tooth and adapter.

19. The tooth assembly according to claim 12, further including a secondary lock for releasably maintaining said securement member in position between said tooth and the nose portion of said adapter.

20. The tooth assembly according to claim 19, wherein said secondary lock includes a detent mechanism for releasably maintaining said securement member in position between said tooth and the nose portion of said adapter.

21. The tooth assembly according to claim 19, wherein said securement member includes magnetic material for releasably maintaining said securement member in position between said tooth and the adapter nose portion.

22. The tooth assembly according to claim 19, wherein said secondary lock includes a insert carried by said tooth, with a portion of said insert being arranged in operable combination with and serves to maintain said securement member in position between said tooth and the nose portion of the adapter.

23. The tooth assembly according to claim 22, wherein the insert of said secondary lock includes magnetic material.

24. A tooth assembly having a longitudinal axis, said tooth assembly comprising:

an adapter with a nose portion having a base portion adapted to be secured to excavating equipment and a forwardly extending nose portion having a first predetermined configuration defined, at least partially, by at least one generally planar surface;

a tooth assembled onto the nose portion of said adapter by relative longitudinal movements, said tooth defining a blind cavity opening to a rear of said tooth, with the blind cavity having a second predetermined configuration, with the second predetermined configuration being larger than said first predetermined configuration such that, when said adapter nose portion and said tooth are arranged in operable combination relative to each other, a space is defined between a confronting surfaces on the blind cavity of said tooth and the nose portion of said adapter;

a lock on said tooth for releasably maintaining said tooth and the adapter nose portion in operable combination relative to each other, with said lock projecting toward the longitudinal axis of said tooth assembly and extending into a recess defined on the adapter nose portion when said adapter nose portion and said tooth are arranged in operable combination relative to each other; and a securement member is insertable in a direction extending generally perpendicular to the longitudinal axis of the tooth assembly such that a portion of said securement member at least partially fills the space defined between the confronting surfaces on the blind cavity of said tooth and the nose portion of said adapter and positively urges the lock into the recess defined in the adapter nose portion whereby resisting longitudinal movement between the tooth and the adapter nose portion as long as said securement member is arranged between said adapter nose portion and said tooth.

25. The tooth assembly according to claim 24, wherein said lock is a free ended projection extends from and formed integral with one surface of the blind cavity on the tooth toward the longitudinal axis of the tooth assembly.

26. The tooth assembly according to claim 24, wherein the lock on said tooth is an insert formed independent of and carried by said tooth.

27. The tooth assembly according to claim 24, wherein said securement member has opposed and generally parallel sides.

28. The tooth assembly according to claim 27, wherein at least one of the sides of the securement member and a confronting surface defined by the blind cavity in said tooth has a key projecting therefrom, and wherein at least one of the sides of the securement member and a confronting surface defined by the blind cavity in said tooth defines a keyway for slidably accommodating said key when the securement member is inserted into operable combination with said tooth and adapter.

29. The tooth assembly according to claim 24, further including a secondary lock for releasably maintaining said securement member in position between said tooth and the nose portion of the adapter.

30. The tooth assembly according to claim 29, wherein said secondary lock includes a detent mechanism for releasably maintaining said lock in position between said tooth and the nose portion of said adapter.

31. The tooth assembly according to claim 29, wherein said secondary lock includes an insert carried by said tooth, with said insert being arranged in operable combination with and serves to maintain said securement member in position between said tooth and the nose portion of the adapter.

32. The tooth assembly according to claim 31, wherein said insert is formed from magnetic material.

33. A tooth assembly having a longitudinal axis, said tooth assembly comprising:

an adapter with a nose portion having a base portion adapted to be secured to excavating equipment and a forwardly extending nose portion having a first predetermined configuration;

a tooth assembled onto the nose portion of said adapter by relative longitudinal and lateral movements, said tooth defining a blind cavity opening to a rear of said tooth, with the blind cavity having a second predetermined configuration defined by at least one side extending generally parallel to the longitudinal axis of said tooth assembly, and with the second predetermined configuration being larger than said first predetermined configuration such that, when said adapter nose portion and said tooth are arranged in operable combination relative to each other, a space is defined between said at least one side on the tooth cavity extending generally parallel to the longitudinal axis of said tooth assembly and a confronting surface on the nose portion of said adapter; and a securement member insertable in a direction extending generally perpendicular to the longitudinal axis of the tooth assembly such that a portion of said securement member at least partially fills the space defined between said at least one side on the tooth cavity extending generally parallel to the longitudinal axis of said tooth assembly and a confronting surface on the nose portion of said adapter to positively urge the tooth in a direction whereby allowing the remaining configurations on the adapter nose portion and tooth cavity to resist longitudinal movement between the tooth and the adapter nose portion as long as said securement member is arranged between said adapter nose portion and said tooth.

34. The tooth assembly according to claim 33, wherein the portion of the securement member insertable between said at least one side on the tooth cavity extending generally parallel to the longitudinal axis of said tooth assembly and a confronting surface on the nose portion of said adapter has a wedge shaped cross-sectional configuration.

35. The tooth assembly according to claim 33, the other surfaces of the blind cavity defined by said tooth angle inwardly toward the longitudinal axis of the tooth assembly such that the lateral width between the side surfaces of said blind cavity is greater at a closed end of the cavity than at an open end of the cavity.

36. A method for releasably coupling a tooth to an adapter on a ground engaging implement, wherein said tooth has an upper wall and a lower wall converging toward a free end of the tooth and a rearwardly opening socket formed therein, with said tooth defining a first predetermined configuration for said socket, and with the predetermined configuration of said socket being at least partially defined by a pair of laterally spaced side surfaces on said tooth, and wherein said adapter has a nose portion adapted to be longitudinally received and accommodated within the socket defined by said tooth, with the nose portion of said adapter having a second predetermined configuration which complements but is smaller than said the predetermined configuration defined by said tooth socket, and with the second predetermined configuration on said adapter being at least partially defined by a pair of laterally spaced sides on the adapter nose portion, and wherein, when the adapter nose portion and tooth are arranged in operable combination relative to each other, a space is provided between the adapter nose portion and the tooth socket, with said method comprising the steps of:

inserting a securement member between one side of the adapter nose portion and a confronting side surface on said tooth socket such that at least a portion of said securement member bears against the socket and the confronting side surface of the tooth socket whereby shifting the tooth laterally relative to the adapter nose portion to inhibit longitudinal translation of the tooth relative to the adapter as long as said securement member is retained between said tooth and the nose portion of the adapter.

37. The method for releasably coupling a tooth to an adapter according to claim 36 including the further step of:

angling said tooth in a first sideways direction sufficiently to permit longitudinal translation of a free end of said adapter into the socket defined by said tooth.

38. The method for releasably coupling a tooth to an adapter according to claim 37 including the further step of:

angling said tooth in a second sideways direction sufficiently to align said tooth and adapter along a longitudinal axis defined by said tooth assembly.

39. The method for releasably coupling a tooth to an adapter according to claim 36 including the further step of:

using a secondary lock for releasably maintaining said securement member between said tooth and adapter and thereby releasably coupling said tooth and adapter in operable combination relative to each other as long as said securement member is maintained therebetween.

* * * * *

UNITED STATES PATENT AND TRADEMARK OFFICE

CERTIFICATE OF CORRECTION

PATENT NO. : 8,347,530 B2
APPLICATION NO. : 12/806010
DATED : January 8, 2013
INVENTOR(S) : Charles Clendenning et al.

It is certified that error appears in the above-identified patent and that said Letters Patent is hereby corrected as shown below:

In the Claims

Column 31, Claim 2, line 24, please replace "said'" with -- said --;
Column 31, Claim 3, line 53, please replace "claim 1" with -- claim 2 --;
Column 31, Claim 4, line 55, please replace "claim 1" with -- claim 2 --;
Column 31, Claim 5, line 59, please replace "claim 1" with -- claim 2 --.

Signed and Sealed this
Sixteenth Day of July, 2013

Teresa Stanek Rea
*Acting Director of the United States Patent and Trademark Office*